US005945269A

United States Patent [19]

Nakatsu

[11] Patent Number: 5,945,269

[45] **Date of Patent: *Aug. 31, 1999**

[54] SILVER HALIDE EMULSION AND SILVER HALIDE PHOTOGRAPHIC MATERIAL COMPRISING SAME

[75] Inventor: Masaharu Nakatsu, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/567,213

[22] Filed: Dec. 5, 1995

Related U.S. Application Data

[63] Continuation of application No. 08/357,249, Dec. 13, 1994, abandoned.

[30] Foreign Application Priority Data

Dec. 13, 1993 [JP] Japan ..... 5-311954

[51] Int. Cl.[6] ..... G03C 1/035

[52] U.S. Cl. ..... 430/567; 430/569; 430/570; 430/603; 430/605

[58] Field of Search ..... 430/567, 569, 430/570, 603, 605

[56] References Cited

U.S. PATENT DOCUMENTS

| | | | |
|---|---|---|---|
| 5,061,615 | 10/1991 | Kase et al. | 430/569 |
| 5,275,930 | 1/1994 | Maskasky | 430/567 |
| 5,314,798 | 5/1994 | Brust et al. | 430/567 |
| 5,320,938 | 6/1994 | House et al. | 430/567 |
| 5,418,124 | 5/1995 | Suga et al. | 430/567 |
| 5,449,596 | 9/1995 | Kawai et al. | 430/567 |
| 5,498,511 | 3/1996 | Yamashita et al. | 430/567 |
| 5,879,874 | 3/1999 | Maskasky et al. | 430/569 |

*Primary Examiner*—Mark F. Huff
*Attorney, Agent, or Firm*—Sughrue, Mion, Zinn, Macpeak & Seas, PLLC

[57] ABSTRACT

The present invention provides an emulsion of high silver chloride content tabular silver halide grains with {100} planes as main planes having an excellent color sensitizability, gradation and preservability which can be quickly processed and a photographic light-sensitive material comprising such an emulsion. A novel silver halide emulsion is provided, comprising tabular silver halide grains having {100} planes as two main parallel planes, an aspect ratio of from not less than 2 to not more than 15, a silver chloride content of not less than 60 mol % and a silver salt present on the surface thereof more difficultly-soluble than silver chloride, in a proportion of not less than 50% of all the silver halide grains contained therein as calculated in terms of projected area.

8 Claims, No Drawings

SILVER HALIDE EMULSION AND SILVER HALIDE PHOTOGRAPHIC MATERIAL COMPRISING SAME

This is a Continuation of application Ser. No. 08/357,249, filed Dec. 13, 1994, now abandoned.

FIELD OF THE INVENTION

The present invention relates to a silver halide photographic material. The present invention also relates to a high silver chloride content silver halide emulsion to provide a photographic material which can be quickly processed, particularly having a high photographic sensitivity, a high gradation and an excellent preservability. The present invention further relates to a photographic light-sensitive material comprising such an emulsion.

BACKGROUND OF THE INVENTION

In recent years, photographic light-sensitive materials have been required to attain various performances. It is well known to those skilled in the art that tabular grains are suitable for silver halide photographic emulsion in the light of sensitivity, graininess, sharpness and color sensitization efficiency. As tabular silver halide grains there are often used high silver bromide content tabular grains having twinning planes and {111} planes as main planes. However, there arises a problem that the rise in the amount of sensitizing dyes to be adsorbed to silver halide grains causes a rise in the inherent desensitization. On the other hand, it has been known that silver halide grains having {100} planes normally exhibit a good color sensitizability. Thus, it has been desired to develop tabular silver halide grains having {100} planes as main planes and provide these silver halide grains with a higher sensitivity.

For the details of high silver bromide content tabular silver halide grains having {100} planes as main planes, reference can be made to A. Mignot, E. Francois and M. Catinat, "Cristaux De Rbomure D'argent Plats, Limites Par Des Faces (100) Etnon Macles", Journal of Crystal Growth 123 (1974) pp. 207–213, JP-A-51-88017 (The term "JP-A" as used herein means an "unexamined published Japanese patent application"), and JP-B-64-8323 (The term "JP-B" as used herein means an "examined Japanese patent publication").

There is no end to the recent demand for simplification and expedition of development. There is also a growing demand for the reduction of the replenishment rate of processing solutions. These demands can advantageously be met by the use of high silver chloride content silver halide grains having a high solubility. For the details of high silver chloride content tabular grains having {100} planes as main planes, reference can be made to EP 0534395A1, and U.S. Pat. No. 5,264,337. However, high silver chloride content tabular silver halide grains are disadvantageous in that they contain twin grains in a high proportion and have a wide grain size distribution as shown in a grain photograph set forth in an example of EP 0534395A1.

On the other hand, it has heretofore been well known that silver halide grains are subjected to halogen conversion to attain a high sensitizability and control the pressure resistance of the grains. U.S. Pat. No. 2,592,250 discloses emulsion grains obtained by subjecting silver chloride grains to halogen conversion with bromide ions or iodide ions. JP-B-50-36978 discloses the use of an emulsion obtained by subjecting the surface of the foregoing emulsion to chemical sensitization. JP-A-61-122641 discloses an emulsion obtained by subjecting an emulsion containing chloride ions to halogen conversion with bromide ions or iodide ions in the presence of a solvent. JP-A-51-2417 discloses a silver halide grain growth method which comprises adding bromide ions or iodide ions to a silver chloride emulsion within 20 minutes after the production thereof so that it is subjected to physical ripening.

However, such a process for the preparation of emulsion grains cannot control the grain formation. As described in the above cited patent, the halogen conversion causes a total change in the size and crystal form of grains. Thus, such a scheme can hardly be applied to tabular grains.

JP-B-61-31454 discloses a method which comprises settling silver bromide on silver chloride grains by an accumulation method rather than by a halogen conversion method. Further, JP-A-63-305343 and JP-A-3-121442 disclose a method which comprises halogen conversion of the surface of grains with iodine to intensify the adsorption of dyes so that the site at which chemically-sensitized nuclei are formed can be con trolled by the site direction function of dyes.

However, these disclosures cannot be applied to high silver chloride content tabular grains having {100} planes as main planes.

SUMMARY OF THE INVENTION

It is therefore an object of the present invention to provide an emulsion of high silver chloride content tabular silver halide grains with {100} planes as main planes having an excellent color sensitizability, gradation and preservability which can be used for a photographic material advantageous for quick processing and a photographic light-sensitive material comprising such an emulsion.

The foregoing and other objects of the present invention will become more apparent from the following detailed description and examples.

The foregoing object of the present invention is accomplished by the following aspects of the present invention:

(1) A silver halide emulsion, comprising tabular silver halide grains having {100} planes as two main parallel planes, an aspect ratio of from not less than 2 to not more than 15, a silver chloride content of not less than 60 mol % and a silver salt present on the surface thereof more difficultly-soluble than silver chloride in a proportion of not less than 50 % of all the silver halide grains contained therein as calculated in terms of projected area.

(2) A silver halide photographic material, comprising a silver halide emulsion as defined in Clause (1) incorporated in at least one silver halide emulsion layer provided on a support.

(3) The silver halide emulsion according to Clause (1), wherein said difficultly soluble salt present on the surface of said emulsion grains is silver bromide, silver iodide or silver bromoiodide.

(4) The silver halide emulsion according to Clause (1), wherein the content (Z) of said difficultly soluble salt on the surface of said tabular silver halide grains is in the range of 0.8 to 1.2 times the average content ($Z_0$) of said difficultly soluble salt on the surface of all the grains.

(5) The silver halide emulsion according to Clause (1), wherein the content (Z) of said difficultly soluble salt on the surface of said tabular silver halide grains is in the range of 0.9 to 1.1 times the average content ($Z_0$) of said difficultly soluble salt on the surface of all the grains.

(6) The silver halide emulsion according to Clause (1), wherein said difficultly soluble salt on the surface of said emulsion grains is formed by the addition of finely divided grains of silver bromide, silver iodide or silver bromoiodide.

(7) The silver halide emulsion according to Clause (1), wherein said difficultly soluble salt on the surface of said emulsion grains is formed in the presence of a compound which releases bromide ions or iodide ions.

(8) The silver halide emulsion according to Clause (1), wherein said emulsion grains are formed in the presence of an agent for oxidizing silver.

(9) The silver halide emulsion according to Clause (1), wherein said emulsion grains have been subjected to sensitization with selenium or tellurium.

(10) The silver halide emulsion according to Clause (1), wherein said emulsion grains have been subjected to sensitization with gold and sulfur.

(11) The silver halide emulsion according to Clause (1), wherein said emulsion grains have been subjected to spectral sensitization with a cyanine dye.

(12) The silver halide emulsion according to Clause (1), wherein said emulsion grains have been subjected to sensitization with gold and sulfur in the presence of a cyanine dye.

DETAILED DESCRIPTION OF THE INVENTION

The silver halide emulsion of the present invention will be described hereinafter.

The emulsion of high silver chloride content tabular grains of the present invention can be prepared via the following procedures:

1) Nucleation Process

Tabular nuclei on which tabular grains grow can be formed at a high production efficiency under conditions such that lattice defects can be induced therein. In order to obtain tabular nuclei with a good reproducibility at a high production efficiency, a method utilizing halogen conversion of produced nuclei can be advantageously used. This method begins with the formation of silver halide nuclei by a reaction of silver salt and halide, followed by the introduction of halide ions which cause the formation of a more difficultly-soluble silver halide to effect halogen conversion.

In some detail, the halogen composition structure of the nucleus formed during nucleation is $(AgX_1|AgX_2)$, $(AgX_1|AgX_4|AgX_3)$ or the like. This structure can be formed, e.g., by a method which comprises adding an aqueous solution of a silver salt and an aqueous solution of a halide by a double jet process so that an in continuous change is made in the halogen composition of the aqueous solution of a halide. Alternatively, a method can be used which comprises adding an aqueous solution of a halide to a dispersant solution, adding an aqueous solution of a silver salt to the solution to form $AgX_1$, adding an aqueous solution of another halide to the solution, and then adding an aqueous solution of a silver salt to the solution to form an $(AgX_1|AgX_2)$ structure. These methods may be used in combination.

$AgX_1$ differs from $AgX_2$, and $AgX_1$ differs from $AgX_2$ and $AgX_2$ differs from $AgX_3$ in $Cl^-$ content or $Br^-$ content by 25 to 100 mol %, preferably 50 to 100 mol %, more preferably 75 to 100 mol %, and/or in $I^-$ content by 5 to 100 mol %, preferably 10 to 100 mol %, more preferably 30 to 100 mol %. In another embodiment, the difference in $Cl^-$ content and $Br^-$ meets the foregoing amount, and the difference in $I^-$ is in the range of 0 to 5 mol %. The size of nucleus is preferably in the range of not more than 0.15 $\mu$m, more preferably from 0.01 to 0.1 $\mu$m.

The molar ratio $AgX_1$:$AgX_2$ in $(AgX_1|AgX_2)$ and the molar ratio $AgX_1$:$AgX_2$:$AgX_3$ in $(AgX_1|AgX_2|AgX_3)$ may be selected so properly that the optimum embodiment of the present invention can be obtained.

The concentration of excess $Br^-$ during nucleation is preferably not more than $10^{-2}$ mol/$\ell$, more preferably not more than $10^{-2.5}$ mol/$\ell$. The concentration of excess $Cl^-$ is preferably in the range of 0.8 to 3.0, more preferably 1.2 to 2.8 as calculated in terms of pCl.

In order to allow uniform nucleation, a dispersant may be incorporated in the aqueous solution of a silver salt and/or aqueous solution of a halide. The dispersant concentration is preferably in the range of not less than 0.01 % by weight, more preferably from 0.02 to 3 % by weight, particularly from 0.03 to 2 % by weight. As the dispersant there may be used a low molecular gelatin having a molecular weight of 3,000 to 60,000, preferably 8,000 to 40,000. More preferably, the aqueous solution of a silver salt and the aqueous solution of a halide are directly added to the solution through a porous addition system having 3 to $10^{15}$, preferably 30 to $10^{15}$ pores. For its details, reference can be made to JP-A-3-21339, JP-A-4-193336, and JP-A-6-86923. The lower the methionine content of gelatin is, the higher is the frequency of formation of defects. The optimum gelatin can be selected from those having a methionine content of 1 to 60 $\mu$mol/g depending on the respective circumstances.

The mixing ratio of twin grains can be lowered by reducing the concentration of excess halogen ion or excess silver ion during nucleation.

An aqueous solution of a silver salt and an aqueous solution of a halide are added to a dispersant solution containing at least a dispersant and water with stirring by a double jet process to effect nucleation.

The concentration of $Cl^-$ in the dispersant solution during nucleation is preferably in the range of not more than $10^{-0.8}$ mol/$\ell$. The concentration of silver ion in the dispersant solution during nucleation is preferably in the range of not more than $10^{-2}$ mol/$\ell$. The pH value of the dispersant solution is preferably in the range of not less than 2, more preferably from 5 to 10. The gelatin concentration is preferably in the range of 0.01 to 3% by weight, more preferably 0.03 to 2% by weight.

The nucleation temperature is not limited. In general, it is preferably in the range of 10° C. to 80° C., more preferably 20° C. to 70° C. The rate at which the aqueous solution of a silver salt is added is preferably in the range of 0.3 to 20 g/min., more preferably 0.5 to 15 g/min. per $\ell$ of the solution in the vessel. The pH value of the solution in the vessel is not specifically limited. In general, it is in the range of 1 to 11, preferably 3 to 10. The optimum pH value can be selected depending on the combination of excess silver ion concentration, temperature, etc.

In the nucleation process, it is preferred that substantially no $NH_3$ be present in the system. "Substantially no $NH_3$" as defined herein means that the concentration $d_0$ of the silver halide solvent, $NH_3$, is not more than 0.5 mol/$\ell$, preferably less than 0.1 mol/$\ell$, more preferably less than 0.02 mol/$\ell$. It is also preferred that substantially no silver halide solvents other than $NH_3$ are present in the system during nucleation and growth. "Substantially no silver halide solvents" as defined herein has the same meaning as $d_0$. Examples of silver halide solvents other than $NH_3$ include fog inhibitors such as thioethers, thioureas, thiocyanates, organic amine compounds and tetrazaindene compounds. Preferred among these silver halide solvents are thioethers, thioureas, and thiocyanates.

2) Ripening Process

It is impossible to prepare tabular grain nucleus alone during nucleation. Therefore, the nucleation process is followed by a ripening process involving Ostwald ripening which allows the growth of tabular grains and the disappearance of other grains. The ripening temperature is not lower than 40° C., preferably from 45° C. to 90° C., more preferably from 50° C. to 80° C.

In the present invention, it is preferred that substantially no silver halide solvents be present in the system also during ripening. The term "substantially no silver halide solvents" is as defined above.

The concentration of excess $Cl^-$ is preferably $10^{-1.2}$ to $10^{-4}$ mol/l, and more preferably $10^{-1.5}$ to $10^{-3}$ mol/l.

The pH value during ripening is in the range of 1 to 12, preferably 1.5 to 8, more preferably 1.7 to 6.

As the dispersant to be used during nucleation, ripening and growth there may be used any known dispersant for silver halide emulsion. In particular, a gelatin having a methionine content of 0 to 50 μmol/g, more preferably 0 to 30 μmol/g, is preferred. Such a gelatin can be advantageously used for ripening and growth to form thinner tabular grains having a uniform size distribution. Other examples of the dispersant which can be preferably used include synthetic high molecular compounds as disclosed in JP-B-52-16365, and "Bulletin of Society of Photographic Science and Technology of Japan", vol. 29 (1), 17, 22 (1966), vol. 30 (1), 10, 19 (1967), vol. 30 (2), 17 (1967), vol. 33 (3), 24 (1967). Further, a crystal habit controlling agent as disclosed in EP 0534395A1 may be used in combination with the dispersant. The dispersant concentration is preferably in the range of 0.1 to 10% by weight. The amount of the crystal habit controlling agent to be used is preferably in the range of $10^{-1}$ to $10^{-6}$ mol/ℓ, more preferably $10^{-2}$ to $10^{-5}$ mol/ℓ. These materials may be added at any time between before nucleation and completion of growth. These materials may be additionally added to the existing dispersant. Alternatively, these materials may be added to the system after the centrifugal separation of the existing dispersant.

3) Growth Process

After the proportion of tabular grains has been raised by ripening, solutes are added to the system to allow the tabular grains to grow further. Examples of the method for adding the solute to the system include (1) a solution addition method (method which comprises the addition of an aqueous solution of a silver salt and an aqueous solution of a halide), (2) a finely divided grain emulsion addition method which comprises the addition of finely divided silver halide grains which have been previously formed, and (3) combination of the two methods. In order to allow tabular grains to grow edgewise preferentially, it is necessary that the tabular grains be allowed to grow in the lowest allowable supersaturation concentration range within which the tabular grains are not subjected to Ostwald ripening. In other words, it is necessary that the low supersaturation concentration is maintained and controlled with a high precision. The method (2) advantageously makes this possible.

In the foregoing finely divided grain emulsion addition method, an emulsion of finely divided silver halide grains having a grain diameter of not more than 0.15 μm, preferably not more than 0.1 μm, more preferably not more than 0.06 μm, is added to the system to effect Ostwald ripening that causes the growth of tabular grains. The addition of the emulsion of finely divided silver halide grains may be effected continuously or intermittently. The emulsion of finely divided grains may be continuously prepared by supplying an aqueous solution of a silver salt and an aqueous solution of a halide into a mixer provided in the vicinity of the reaction vessel, and then immediately supplied continuously into the reaction vessel. Alternatively, the emulsion of finely divided grains may be previously prepared batchwise, and then continuously or intermittently supplied into the reaction vessel. Preferred is the finely divided grains being substantially free of twin grains. The term "substantially free of twin grains" as used herein is meant to indicate that the proportion of twin grains by number is in the range of not more than 5%, preferably not more than 1%, more preferably not more than 0.5%.

The finely divided grains may be in the form of mixed crystal made of two or more halogen compositions such as silver chloride, silver bromide and silver iodide.

The solution conditions under which the grains grow are the same as used in the foregoing ripening process. This is because that both processes involve Ostwald ripening that allows the growth of tabular grains and the disappearance of other grains, and thus are mechanically the same. For the details of the finely divided grain emulsion addition method, reference can be made to JP-A-4-34544, JP-A-5-281640, and JP-A-1-183417.

In order to form finely divided grains substantially free of twinning planes, an aqueous solution of a silver salt and an aqueous solution of a halide may be added in an excess halide ion concentration or excess silver ion concentration of preferably not more than $10^{-2}$ mol/ℓby a double jet process.

The temperature at which finely divided grains are formed is preferably not higher than 50° C., more preferably from 5° C. to 40° C., more preferably from 10° C. to 35° C. As the dispersant to control the formation of finely divided grains, there may be preferably used a gelatin comprising a low molecular gelatin having a molecular weight of preferably 2,000 to $6\times10^4$, more preferably 5,000 to $4\times10^4$, in an amount of preferably not less than 30% by weight, more preferably not less than 60% by weight, particularly not less than 80% by weight. The dispersant concentration is preferably in the range of not less than 0.02% by weight, more preferably from 0.03% by weight to 5% by weight.

Dislocation lines can be introduced into grains during the formation of grains by the halogen composition gap method, halogen conversion method, epitaxial growth method or combination thereof. This advantageously further improves the pressure fog characteristics, reciprocity law characteristics, and color sensitizability. For details, reference can be made to JP-A-63-220238, 64-26839, 2-127635, 3-189642, 3-175440, and 2-123346, EP 0460656A1, and "Journal of Imaging Science", vol. 32, pp. 160–177 (1988).

The Aspect ratio of the grains is controlled with the concentration of excess ion (pAg). The grains are grown in an excess ion concentration of $Ag^+$ and $Cl^-$ of not more than $10^{-1.5}$ mol/l and preferably not more than $10^{-2.0}$ mol/l With the grains thus obtained as host grains, epitaxial grains may be formed. With the grains as core grains, grains having dislocation lines there inside may be formed. Further, with the grains as substrates, silver halide layers having halogen compositions different from that of the substrates may be integrated to prepare grains having various known grain structures. For details, reference can be made to literatures as described later.

Further, with the tabular grains as cores, a shallow internal latent image emulsion may be formed. Moreover, a core/shell type grain may be formed. For details, reference can be made to JP-A-59-133542, and 63-151618, and U.S. Pat. Nos. 3,206,313, 3,317,322, 3,761,276, 4,269,927, and 3,367,778.

As mentioned above, the most important parameter for eventually obtaining silver halide grains having a high aspect ratio is pAg during ripening and growth.

The term "aspect ratio" as used herein means the ratio of the thickness of a grain between the main planes to the average length of edges forming the main planes. The "main planes" are defined as a pair of parallel planes having the greatest area among the surfaces forming a substantially rectangular parallelepiped emulsion grain. The main planes can be confirmed to be {100} planes by electron diffractometry or X-ray diffractometry. The term "substantially rectangular parallelepiped emulsion grain" as used herein means an emulsion grain having main planes formed by {100} planes but possibly having 1 to 8 of {111} crystal plane. In other words, 1 to 8 among the eight corners of the rectangular parallelepiped may be cut. The term "average length of edges" as used herein means the length of a side of the square having the same area as the projected area of the emulsion grain determined on its electron microphotograph.

4) Halogen Composition Conversion of the Surface of Grain

The present invention is based on an invention that a salt more difficultly-soluble than silver chloride is formed on the surface of high silver chloride content tabular grains having {100} planes as main planes uniformly from grain to grain to allow a sensitizing dye to be adsorbed to the grains uniformly from grain to grain.

Examples of the silver salt more difficultly-soluble than silver chloride include silver bromide, silver iodide, silver bromoiodide, silver thiocyanate, silver selenocyanate, and mixed crystal thereof. Preferred among these silver salts are silver bromide, silver iodide, and silver bromoiodide. The amount of the silver salt more difficultly-soluble than silver chloride is in the range of from not less than 0.001 mol % to not more than 20 mol %, preferably not more than 10 mol %, more preferably not more than 5 mol %, based on the total amount of grains.

As the method for allowing the silver salt more difficultly-soluble than silver chloride to be present on the surface of the tabular grains there may be used a method which comprises the addition of an aqueous solution of a halide having the corresponding composition and an aqueous solution of a silver salt having the corresponding composition by a double jet process, a finely divided grain emulsion addition method, or a method which comprises the use of a bromide ion- or iodide ion-releasing agent.

The method which comprises the addition of an aqueous solution of a halide and a water-soluble silver salt by a double jet process is disadvantageous in that even if the aqueous solution of a halide or the like is added in diluted form, halogen ions must be added in free state, restricting the minimization of intergrain locality. This method finds difficulty particularly in tabular grains. On the other hand, the finely divided grain emulsion addition method or the method which comprises the use of an ion-releasing agent advantageously allows the formation of a salt more difficultly-soluble than silver chloride on the surface of grains uniformly from grain to grain.

In the finely divided grain emulsion addition method, the average diameter of the grains in sphere equivalent is preferably in the range of not more than 0.1 μm, more preferably not more than 0.06 μm. The emulsion of finely divided grains may be continuously prepared by supplying an aqueous solution of a silver salt and an aqueous solution of salt capable of forming a silver salt having a low solubility than silver chloride into a mixer provided in the vicinity of the reaction vessel, and then immediately supplied into the reaction vessel. Alternatively, the emulsion of finely divided grains may be previously prepared batchwise, and then supplied into the reaction vessel. The method which comprises the use of an ion-releasing agent is disclosed in JP-A-1-285942, which corresponds to U.S. Pat. No. 5,061,615 and in Japanese Patent Application No. 5-58039 which corresponds to U.S. Pat. No. 5,418,124, the disclosures of which are incorporated herein by reference.

The tabular silver halide grain emulsion of the present invention obtained via the foregoing procedures comprises tabular silver halide grains having {100} planes as two main parallel planes, an aspect ratio of from not less than 2 to not more than 15, a silver chloride content of not less than 60 mol % and a silver salt present on the surface thereof more difficultly-soluble than silver chloride in a proportion of not less than 50% of all the silver halide grains contained therein as calculated in terms of projected area. The aspect ratio of the tabular grains is in the range of from not less than 2 to not more than 15, preferably from not less than 3 to not more than 13, more preferably from not less than 4 to not more than 10. The foregoing optimum aspect ratio range is determined by the balance of sensitivity and pressure properties. The silver chloride content of grain is preferably in the range of not less than 80 mol %, more preferably not less than 90%, most preferably not less than 95%. The proportion of the tabular silver halide grains having a silver salt more difficultly-soluble than silver chloride present on the surface thereof in all the silver halide grains is preferably in the range of not less than 60%, most preferably not less than 70%, as calculated in terms of projected area.

The content (Z) of the difficultly-soluble silver salt present on the surface of the tabular silver halide grains is in the range of from 0.8 to 1.2 times, preferably 0.9 to 1.1 times, the average content ($Z_0$) of the difficultly-soluble silver salt present on the surface of all the grains. The halogen composition of grain can be determined by means of an electron probe micro analyzer.

The present photographic light-sensitive material can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red-sensitive layer, green-sensitive layer and blue-sensitive layer as viewed from the support. However, the order of arrangement can be optionally reversed depending on the purpose of application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038. These interlayers can further comprise a color stain inhibitor as commonly used.

The plurality of silver halide emulsion layers constituting each unit light-sensitive layer can be preferably in a two-layer structure, i.e., high sensitivity emulsion layer and low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided remote from the support while a high sensitivity emulsion layer can be provided nearer to the support.

In an embodiment of such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) can be arranged in this order remote from the support. In another embodiment, BH, BL, GL, GH, RH, and RL can be arranged in this order remote from the support. In a further embodiment, BH, BL, GH, GL, RL, and RH can be arranged in this order remote from the support.

As described in JP-B-55-34932 (The term "JP-B" as used herein means an "examined Japanese patent publication"), blue-sensitive layer, GH, RH, GL, and RL can be arranged in this order remote from the support. Alternatively, as described in JP-A-56-25738 and JP-A-62-63936, a blue-sensitive layer, GL, RL, GH, and RH can be arranged in this order remote from the support.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangement, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order remote from the support in a color-sensitive layer as described in JP-A-59-202464.

Alternatively, a high sensitivity emulsion layer, a low sensitivity emulsion layer and a middle sensitivity emulsion layer or a low sensitivity emulsion layer, a middle sensitivity emulsion layer and a high sensitivity emulsion layer may be arranged in this order.

In the case of four-layer structure, too, the arrangement of layers may be similarly altered.

As described above, various layer structures and arrangements can be selected depending on the purpose of light-sensitive material.

In the photographic light-sensitive material of the present invention, at least one silver halide emulsion layer provided on a support comprises a silver halide emulsion of the present invention in an amount of not less than 30%, preferably not less than 50%, more preferably not less than 70%

The silver halide composition other than the silver halide of the present invention to be incorporated in the photographic emulsion layer in the photographic light-sensitive material of the present invention preferably comprises silver bromoiodide, silver chloroiodide or silver bromochloroiodide having a silver iodide content of not more than about 30 mol %. Silver bromoiodide or silver bromochloroiodide having a silver iodide content of from about 2 mol % to about 10 mol % is most preferred. However, the total content of silver bromide in the light-sensitive material is preferably low, and so is the silver iodide content.

Silver halide grains in the present invention emulsions may be so-called regular grains having a regular crystal form, such as cube, octahedron and tetradecahedron, or those having an irregular crystal form such as sphere and tablet, those having a crystal defect such as twinning plane, or those having a combination of these crystal forms.

The silver halide grains other than the silver halide composition of the present invention may be either fine grains of about 0.2 $\mu$m or smaller in diameter or giant grains having a projected area diameter of up to about 10 $\mu$m. The emulsion may be either a monodisperse emulsion or a polydisperse emulsion.

The silver halide emulsion of the present invention is normally subjected to physical ripening, chemical ripening and spectral sensitization before use.

The method which comprises the addition of a chalcogen compound as described in U.S. Pat. No. 3,772,031 may be optionally used. Besides S, Se and Te, cyanates, thiocyanates, selenocyanic acid, carbonates, phosphates and acetates may be present in the system.

The silver halide grains to be used in the present invention may be subjected to at least one of sulfur sensitization, selenium sensitization, gold sensitization, palladium sensitization, sensitization with other noble metals, and reduction sensitization at any step during the preparation of the silver halide emulsion. It is preferred that two or more of these sensitization methods be used in combination. Various types of emulsions can be prepared by varying the step at which chemical sensitization is effected. Examples of these types of emulsions include a type of emulsion having a chemically sensitized nucleus embedded in grain, a type of emulsion having a chemically sensitized nucleus embedded shallow in grain, and a type of emulsion having a chemically sensitized nucleus formed on the surface of grain. The position at which the chemically sensitized nucleus is present in the emulsion of the present invention may be selected depending on the purpose. In a preferred embodiment, at least a kind of chemically sensitized nucleus is formed in the vicinity of the surface of grain.

One of chemical sensitization methods which can be preferably effected is chalcogen sensitization method or noble metal sensitization method or combination thereof. The chemical sensitization can be effected with active gelatin as disclosed in T. H. James, "The Theory of the Photographic Process", 4th ed., Macmillan, 1977, pp. 67–76. The chemical sensitization can also be effected with sulfur, selenium, tellurium, gold, platinum, palladium or iridium or combination thereof at pAg 5 to 10, pH 5 to 8 and a temperature of 30 to 80° C. as disclosed in Research Disclosure, vol. 120, April 1974, 12008, Research Disclosure, vol. 34, June 1975, 13452, U.S. Pat. Nos. 2,642,361, 3,297,446, 3,772,031, 3,857,711, 3,901,714, 4,266,018, and 3,904,415, and British Patent 1,315,755. The noble metal sensitization may be effected with a noble metal such as gold, platinum, palladium and iridium. Particularly preferred among these noble metal sensitization methods are gold sensitization, palladium sensitization, and combination thereof. The gold sensitization method may be effected with a known compound such as chloroauric acid, potassium chloroaurate, potassium aurithiocyanate, gold sulfide and gold selenide. The palladium compound means a divalent or tetravalent palladium salt. A preferred palladium compound is represented by $R_2PdX_6$ or $R_2PdX_4$ wherein R represents a hydrogen atom, alkaline metal atom or ammonium group, and X represents a halogen atom such as chlorine atom, bromine atom and iodine atom.

In some detail, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferred. The gold compound and palladium compound are preferably used in combination with a thiocyanate or selenocyanate.

As the sulfur sensitizer there may be used hypo, thiourea compound, rhodanine compound or sulfur-containing compound as disclosed in U.S. Pat. Nos. 3,857,711, 4,266,018 and 4,054,457. The chemical sensitization method can be effected in the presence of a so-called chemical sensitizing aid. As such a chemical sensitizing aid there may be used a compound which inhibits fogging during chemical sensitization and enhances sensitivity, e.g., azaindene, azapyridazine and azapyrimidine. Examples of chemical sensitizing aid improvers are described in U.S. Pat. Nos. 2,131,038, 3,411,914, 3,554,757, JP-A-58-126526, and Duffin, "Chemistry of Photographic Emulsion", pp. 138–143.

The emulsion of the present invention is preferably subjected to gold sensitization and sulfur sensitization in combination. The optimum amount of gold sensitizer or sulfur sensitizer is in the range of $1\times10^{-4}$ to $1\times10^{-7}$ mol, preferably $1\times10^{-5}$ to $5\times10^{-7}$ mol.

The optimum sensitization method to which the emulsion of the present invention is subjected is selenium sensitization. The selenium sensitization method may be effected with a known instable selenium compound. In some detail, selenium compounds such as colloidal metallic selenium, selenourea (e.g., N,N-dimethylselenourea, N,N-diethylselenourea), selenoketone and selenoamide can be used. The selenium sensitization method may be optionally effected in combination with sulfur sensitization or noble metal sensitization or combination thereof.

The silver halide emulsion according to the present invention is preferably subjected to reduction sensitization during grain formation, between after grain formation and before chemical sensitization, during chemical sensitization or after chemical sensitization.

As reduction sensitization there can be selected from a process which comprises the addition of a reduction sensitizer to a silver halide emulsion, a process called silver ripening which comprises allowing silver halide grains to grow or ripening silver halide grains in an atmosphere of pAg as low as 1 to 7, and a process called high pH ripening which comprises allowing silver halide grains to grow or ripening silver halide grains in an atmosphere of pH as high as 8 to 11. Two or more of these processes may be used in combination.

The foregoing process involving the addition of a reduction sensitizer is advantageous in that the level of reduction sensitization can be closely controlled.

As reduction sensitizers there have been known stannous salts, ascorbic acid and derivatives thereof, amines, polyamines, hydrazine derivative, formamidinesulfinic acid, silane compounds, and borane compounds. As the reduction sensitizer employable in the present invention there can be selectively used any of these known reduction sensitizers. Two or more of these compounds may be used in combination. Preferred examples of reduction sensitizers employable in the present invention stannous chloride, thiourea dioxide, dimethylamineborane, and ascorbic acid and derivatives thereof. The amount of the reduction sensitizer to be added in the present invention needs to be selected depending on the production conditions of emulsion and is preferably from $10^{-7}$ mol to $10^{-3}$ mol per mol of silver halide.

The reduction sensitizer may be added to the system in the form of solution in a solvent such as water, alcohol, glycol, ketone, ester and amide during the growth of grains. The reduction sensitizer may be previously added to the system in the reaction vessel. Preferably, it is added to the system at any proper time during the growth of silver halide grains. Alternatively, the reduction sensitizer may be previously added to an aqueous solution of a water-soluble silver salt or water-soluble alkali halide which is then subjected to precipitation of silver halide grains. In another preferred example, the reduction sensitization solution may be added to the system in several batches or in a continuous manner for a prolonged period of time with the progress of growth of silver halide grains.

A silver oxidizing agent is preferably used during the preparation of the emulsion of the present invention. The term "silver oxidizing agent" as used herein means a compound which acts on metallic silver to convert it to silver ion. In particular, a compound which converts extremely minute silver grains by-produced during the formation and chemical sensitization of silver halide grains to silver ions is useful. The silver ions produced during this process may form a silver salt difficultly soluble in water, such as silver halide, silver sulfate and silver selenide or a silver salt easily soluble in water, such as silver nitrate. The silver oxidizing agent may be an inorganic or organic compound. Examples of the inorganic oxidizing agent include ozone, hydrogen peroxide, adducts thereof (e.g., $NaBO_2.H_2O_2.3H_2O$, $2NaCO_3.3H_2O_2$, $Na_4P_2O_7.2H_2O_2$, $2Na_2SO_4.H_2O_2$), peroxy acid salts (e.g., $K_2S_2O_8$, $K_2C_2O_6$, $K_2P_2O_8$) peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), oxygen acid salts such as permanganate (e.g., $KMnO_4$) and chromate (e.g., $K_2Cr_2O_7$), halogen elements such as iodine and bromine, perhalogenates (e.g., potassium periodate), salts of metal having a high valency (e.g., potassium ferric hexacyanoate), and thiosulfonates.

Examples of the organic oxidizing agent include quinones such as p-quinone, organic peroxides such as peracetic acid and perbenzoic acid, and compounds which release active halogen (e.g., N-bromosuccimide, chloramine T, Chloramine B).

Preferred among these oxidizing agents are inorganic oxidizing agents such as ozone, hydrogen peroxide and adducts thereof, halogen elements and thiosulfonates, and organic oxidizing agents such as quinone. In a preferred embodiment, the foregoing reduction sensitization method is effected in combination with the use of the foregoing silver oxidizing agent. The use of the oxidizing agent may be followed by the reduction sensitization, or vice versa, or may be effected at the same time with the reduction sensitization. These methods may be selectively effected at the grain formation process or chemical sensitization process.

The photographic emulsion to be used in the present invention can comprise various compounds for the purpose of inhibiting fogging during the preparation, storage or photographic processing of the light-sensitive material or stabilizing the photographic properties. In particular, there can be used many compounds known as fog inhibitors or stabilizers. Examples of these fog inhibitors or stabilizers include thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole), mercaptopyrimidines, mercaptotriazines, thioketo compounds such as oxadolinethione, azaindenes such as triazaindenes, tetraazaindenes (particularly 4-hydroxy-substituted (1,3,3a,7) tetraazaindenes), and pentaazaindenes. For example, those described in U.S. Pat. Nos. 3,954,474, and 3,982,947, and JP-B-52-28660 can be used. One of preferred compounds includes that disclosed in JP-A-63-212932. These fog inhibitors and stabilizers may be added at any time before, during and after the formation of grain, during rinsing, during dispersion after rinsing, before, during and after chemical sensitization, and before coating depending on the purpose. These fog inhibitors and stabilizers can exert the inherent effect of inhibiting fog and stabilizing the emulsion when added during the preparation of the emulsion as well as many other effects, i.e., controlling the crystal habit of grain, chemical sensitization and dye arrangement, reducing the grain size and the grain solubility, etc.

The silver halide emulsion according to the present invention can be advantageously subjected to spectral sensitization with a methane dye or other dyes to exert the effects of the present invention. Examples of a spectral sensitizing dye to be used in the present invention include cyanine dye, melocyanine dye, composite cyanine dye, composite melocyanine dye, holopolar cyanine dye, hemicyanine dye, styryl dye, and hemioxonol dye. Particularly useful among these dyes are cyanine dye, melocyanine dye, and composite melocyanine dye. Any of nuclei which are commonly used as basic heterocyclic nuclei for cyanine dyes can be applied to these dyes. Examples of suitable nuclei which can be applied to these dyes include pyrroline nucleus, oxazoline nucleus, thiazoline nucleus, pyrrole nucleus, oxazole nucleus, thiazole nucleus, selenzazole nucleus, imidazole nucleus, tetrazole nucleus, pyrridine nucleus, and nucleus obtained by fusion of alicyclic hydrocarbon rings to these nucleus or nucleus obtained by fusion of aromatic hydrocarbon rings to these groups, e.g., indolenine nucleus, benzindolenine nucleusm indole nucleus, benzoxazole nucleus, naphthooxazole nucleus, benzothiazole nucleus, naphthothiazole nucleus, benzoselenazole nucleus, benzimidazole nucleus and quinoline nucleus. These nuclei may contain substituents on carbon atoms.

Examples of suitable nuclei which can be applied to melocyanine dye or composite melocyanine dye include those having a ketomethylene structure such as 5- or 6-membered heterocyclic nucleus, e.g., pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

These sensitizing dyes can be used singly or in combination. In particular, a combination of sensitizing dyes is often used for the purpose of supersensitization. Typical examples of such a combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281, and 1,507,803, JP-B-43-4936, and 53-12375, and JP-A-52-110618, and 52-109925.

In combination with these sensitizing dyes, a dye which doesn't exhibit a spectral sensitizing effect itself or a substance which doesn't substantially absorb visible light but exhibits a supersensitizing effect can be incorporated in the emulsion.

These sensitizing dyes may be added to the emulsion at any stage in the preparation of the emulsion which has heretofore been known useful. In general, it may be added between the completion of chemical sensitization and the coating. As described in U.S. Pat. Nos. 3,628,969, and 4,225,666, it may be added at the same time with the chemical sensitizer to effect spectral sensitization and chemical sensitization at the same time. Alternatively, as described in JP-A-58-113928, it may be added before the chemical sensitization or it may be added before the completion of the precipitation of silver halide grains to initiate the spectral sensitization. Further, as taught in U.S. Pat. No. 4,225,666, the above mentioned compound may be added batchwise, that is, part of the compound may be added before the chemical sensitization and the rest of the compound may be added after the chemical sensitization. As taught in U.S. Pat. No. 4,183,756, it may be added at any stage during the formation of silver halide grains.

The silver halide emulsion of the present invention is preferably subjected to spectral sensitization with a cyanine dye. The time at which the sensitizing dye is added to the emulsion is preferably the same as, more preferably prior to the time at which the chemical sensitizer is added.

The added amount of the sensitizing dye is in the range of $4\times10^{-6}$ to $8\times10^{-3}$ mol per mol of silver halide. For silver halide grains having a size of 0.2 to 1.2 $\mu$m which is preferred in the present invention, it is preferably in the range of about $5\times10^{-5}$ to $2\times10^{-3}$ mol per mol of silver halide.

The emulsion of the present invention may comprise the foregoing various additives as well as other various additives depending on the purpose.

These additives are further described in Research Disclosure Item 17643 (December 1978), Item 18716 (November 1979), and Item 308119 (December 1989). The places where these additives are described in these references will be tabulated in Table 1 below.

| Kind of additive | RD17643 | RD18716 | RD308119 |
|---|---|---|---|
| 1. Chemical sensitizer | p. 23 | p. 648 right column (RC) | p. 996 |
| 2. Sensitivity increasing agent | | p. 648 right column (RC) | |
| 3. Spectral sensitizer and supersensitizer | pp. 23–24 | p.648 RC–p. 649 RC | p. 996 RC–p. 998 RC |
| 4. Brightening agent | p. 24 | | p. 998 RC |
| 5. Antifoggant and stabilizer | pp. 24–25 | p. 649 RC | p. 998 RC<br>p. 1000 RC |
| 6. Light absorbent, filter dye, and ultraviolet absorbent | pp. 25–26 | p. 649 RC–p. 650 left column (LC) | p. 1003 LC–P. 1003 RC |
| 7. Stain inhibitor | p. 25 RC | p. 650 LC–RC | P. 1002 RC |
| 8. Dye image stabilizer | p. 25 | | P. 1002 RC |
| 9. Hardening agent | p. 26 | p. 651 LC | P. 1004 RC–P. 1005 LC |
| 10. Binder | p. 26 | p. 651 LC | P. 1003 RC–P. 1004 RC |
| 11. Plasticizer and lubricant | p. 27 | p. 650 RC | P. 1006 LC–RC |
| 12. Coating aid and surface active agent | pp. 26–27 | p. 650 RC | P. 1005 LC–P. 1006 LC |
| 13. Antistatic agent | p. 27 | p. 650 RC | P. 1006 RC–P. 1007 LC |
| 14. Matting agent | | | P. 1008 LC–P. 1009 LC |

In the light-sensitive material of the present invention, two or more kinds of light-sensitive halide emulsions which are different in at least one of grain size, grain size distribution, halogen composition, grain shape and sensitivity may be incorporated in the same layer in admixture.

Surface-fogged silver halide grains as described in U.S. Pat. No. 4,082,553, internally-fogged silver halide grains as described in U.S. Pat. No. 4,626,498 and JP-A-59-214852, or colloidal silver may be preferably incorporated in a light-sensitive silver halide emulsion layer and/or substantially light-insensitive hydrophilic colloidal layer. The term "internally- or surface-fogged silver halide grains" as used herein means "silver halide grains which can be uniformly (nonimagewise) developed regardless of whether they were present in the exposed portion or unexposed portion on the light-sensitive material". Processes for the preparation of internally- or surface-fogged silver halide grains are described in U.S. Pat. No. 4,626,498, and JP-A-59-214852.

Silver halides forming the core of internally-fogged core/shell type silver halide grains may have the same or different halogen compositions. Internally- or surface-fogged silver halide grains may comprise any of silver chloride, silver bromochloride, silver bromoiodide and silver bromochloroiodide. The size of these fogged silver halide grains is not specifically limited, and its average grain size is preferably in the range of 0.01 to 0.75 $\mu$m, particularly 0.05 to 0.6 $\mu$m. The form of these grains is not specifically limited and may be regular. These emulsions may be polydisperse but is preferably monodisperse (silver halide grains at least 95% by weight or number of which are those having grain diameters falling within ±40% from the average grain size).

In the present invention, light-insensitive finely divided silver halide grains are preferably used. Light-sensitive finely divided silver halide grains are silver halide grains which are not sensitive to light upon imagewise exposure for taking of dye images so that they are not substantially developed at development process. Preferably, these silver halide grains are not previously fogged.

These finely divided silver halide grains have a silver bromide content of 0 to 100 mole % and may optionally contain silver chloride and/or silver iodide, preferably 0.5 to 10 mole % of silver iodide.

These finely divided silver halide grains preferably have an average diameter of 0.01 to 0.5 $\mu$m, more preferably 0.02 to 0.2 $\mu$m as calculated in terms of diameter of circle having the same area as the projected area of grain.

These finely divided silver halide grains can be prepared in the same manner as ordinary light-sensitive silver halide. In this case, the surface of the silver halide grains needs neither chemically nor spectrally be sensitized. However, prior to the addition of the emulsion to a coating solution, a known additive such as triazole, azaindene, benzothiazolium or mercapto compound and zinc compound is preferably added to the emulsion. Colloidal silver is preferably incorporated in the layer containing these finely divided silver halide grains.

The coated amount of silver in the light-sensitive material of the present invention is preferably in the range of 6.0 g/m$^2$ or less, most preferably 4.5 g/m$^2$ or less.

Known photographic additives which can be used in the present invention are also described in the above cited three Research Disclosures as tabulated in Table 1 later.

In order to inhibit deterioration in photographic properties due to formaldehyde gas, a compound capable of reacting with and solidifying formaldehyde as disclosed in U.S. Pat. No. 4,411,987 and 4,435,503 can be incorporated in the light-sensitive material.

The light-sensitive material of the present invention preferably comprises a mercapto compound as disclosed in U.S. Pat. No. 4,740,454, and 4,788,132, and JP-A-62-18539, and 1-283551.

The light-sensitive material of the present invention preferably contains a fogging agent, a development accelerator, a silver halide solvent or a compound for releasing precursors thereof as disclosed in JP-A-1-106052 regardless of the amount of developed silver produced by development.

The light-sensitive material of the present invention preferably comprises a dye which has been dispersed by a method as disclosed in International Patent Disclosure WO88/04794 and JP-A-1-502912 or a dye as disclosed in EP317,308A, U.S. Pat. No. 4,420,555, and JP-A-1-259358.

The light-sensitive material to be processed in the present invention can comprise various color couplers. Specific examples of the color couplers are described in the patents described in the above cited Research Disclosure No. 17643, VII-C to G, and No. 307105, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and EP 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,067, 4,500,630, 4,540,654, and 4,556,630, European Patent 73,636, JP-A-60-33552, 60-43659, 61-72238, 60-35730, 55-118034, and 60-185951, RD Nos. 24220 (June 1984) and 24230 (June 1984), and WO88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Laid Open No. 3,329,729, European Patents 121,365A and 249,453A, and JP-A-61-42658.

Typical examples of polymerized dye-forming couplers are described in U.S. Pat. Nos. 3,451,820, 4,080,211, 4,367,282, 4,409,320, and 4,576,910, British Patent 2,102,173, and European Patent 341,188A.

Couplers which form a dye having moderate diffusibility preferably include those described in U.S. Pat. No. 4,366,237, British Patent 2,125,570, European Patent 96,570, and West German Patent Publication (Laid Open) No. 3,234,533.

Colored couplers for correction of unnecessary absorptions of the developed dye preferably include those described in Research Disclosure No. 17643, VII-G, Research Disclosure No. 307105, VII-G, U.S. Pat. Nos. 4,163,670, 4,004,929, and 4,138,258, JP-B-57-39413, and British Patent 1,146,368. Furthermore, couplers for correction of unnecessary absorption of the developed dye by a fluorescent dye released upon coupling as described in U.S. Pat. No. 4,774,181 and couplers containing as a separatable group a dye precursor group capable of reacting with a developing agent to form a dye as described in U.S. Pat. No. 4,777,120 can be preferably used.

Compounds capable of releasing a photographically useful residue upon coupling can also be used in the present invention. Preferred examples of DIR couplers which release a development inhibitor are described in the patents cited in RD 17643, VII-F, RD 307105, VII-F, JP-A-57-151944, 57-154234, 60-184248, 63-37346, and 63-37350, and U.S. Pat. Nos. 4,248,962, and 4,782,012.

Couplers capable of imagewise releasing a nucleating agent or a developing accelerator at the time of development preferably include those described in British Patents 2,097,140 and 2,131,188, and JP-A-59-157638 and 59-170840. Further, compounds which undergo redox reaction with the oxidation product of a developing agent to release a fogging agent, a development accelerator, a silver halide solvent or the like as disclosed in JP-A-60-107029, 60-252340, 1-44940, and 1-45687 are preferred.

In addition to the foregoing couplers, the photographic material according to the present invention can further comprise competing couplers as described in U.S. Pat. No. 4,130,427, polyequivalent couplers as described in U.S. Pat.

Nos. 4,283,472, 4,338,393, and 4,310,618, DIR redox compound- or DIR coupler-releasing coupler, DIR coupler-releasing redox compound or DIR redox-releasing redox compound as described in JP-A-60-185950 and 62-24252, couplers capable of releasing a dye which returns to its original color after release as described in European Patents 173,302A and 313,308A, bleach accelerator-releasing couplers as described in R.D. Nos. 11449 and 24241, couplers capable of releasing a ligand as described in U.S. Pat. No. 4,555,477, couplers capable of releasing a leuco dye as described in JP-A-63-75747, and couplers capable of releasing a fluorescent dye as described in U.S. Pat. No. 4,774,181.

The incorporation of the couplers of the present invention in the light-sensitive material can be accomplished by any suitable known dispersion method.

Examples of high boiling solvents to be used in the oil-in-water dispersion process are described in U.S. Pat. No. 2,322,027.

Specific examples of high boiling organic solvents having a boiling point of 175° C. or higher at normal pressure which can be used in the oil-in-water dispersion process include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl) isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion method and specific examples of latexes to be used in dipping are described in U.S. Pat. No. 4,199,363, West German Patent Application (OLS) 2,541,274, and 2,541,230.

The photographic light-sensitive material of the present invention preferably comprises various antiseptics or antifungal agents such as phenetyl alcohol and 1,2-benzisothiazoline-3-one, n-butyl-p-hydroxybenzoate, phenol, 4-chloro-3,5-dimethylphenol, 2-phenoxyethanol and 2-(4-thiazolyl)benzimidazole as described in JP-A-63-257747, 62-272248 and 1-80941.

The present invention is applicable to various types of photographic light-sensitive materials, particularly preferably to color negative films for common use or motion picture, color reversal films for slide or television, color papers, color positive films and color reversal papers.

Suitable supports which can be used in the present invention are described in the above cited RD 17643 (page 28), No. 18716 (right column on page 647 to left column on page 648), and No. 307105 (page 897).

In the present light-sensitive material, the total thickness of all hydrophilic colloidal layers on the emulsion side is preferably in the range of 28 μm or less, more preferably 23 μm or less, further preferably 18 μm, particularly 16 μm. The film swelling $T_{1/2}$ is preferably in the range of 30 seconds or less, more preferably 20 seconds or less. In the present invention, the film thickness is determined after being stored at a temperature of 25° C. and a relative humidity of 55% for 2 days. The film swelling $T_{1/2}$ can be determined by a method known in the art, e.g., by means of a swellometer of the type as described in A. Green et al., "Photographic Science and Engineering", vol. 19, No. 2, pp. 124–129. $T_{1/2}$ is defined as the time taken until half the saturated film thickness is reached wherein the saturated film thickness is 90% of the maximum swollen film thickness reached when the light-sensitive material is processed with a color developer at a temperature of 30° C. over 195 seconds.

The film swelling $T_{1/2}$ can be adjusted by adding a film hardener to gelatin as binder or altering the ageing condition after coating. The percentage swelling of the light-sensitive material is preferably in the range of 150 to 400%. The percentage swelling can be calculated from the maximum swollen film thickness determined as described above in accordance with the equation: (maximum swollen film thickness−film thickness)/film thickness.

The light-sensitive material of the present invention preferably comprises a hydrophilic colloidal layer (hereinafter referred to as "back layer") having a total dried thickness of 2 μm to 20 μm on the other side other than the emulsion layer side. The back layer preferably contains the above mentioned light absorbent, filter dye, ultraviolet absorbent, antistatic agent, film hardener, binder, plasticizer, lubricant, coating aid, surface active agent, etc. The back layer preferably exhibits a percentage swelling of 150 to 500%.

The photographic light-sensitive material according to the present invention can be developed in accordance with an ordinary method as described in RD Nos. 17643 (pp. 28–29), 18716 (left column–right column on page 651) and 307105 (pp. 880–881).

The color developer to be used in the development of the present light-sensitive material is preferably an alkaline aqueous containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline,3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline,4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and sulfates, hydrochlorides and p-toluenesulfonates thereof. Particularly preferred among these compounds are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and hydrochlorides, p-toluenesulfonates and sulfates thereof. These compounds can be used in combination of two or more thereof depending on the purpose of application.

The amount of the aromatic primary amine developing agent to be used is preferably in the range of 0.0002 to 0.2 mol, more preferably 0.001 to 0.1 mol per ℓ of color developer.

The color developer normally contains a pH buffer such as carbonate, borate, phosphate and 5-sulfosalicylate of alkaline metal or a development inhibitor or fog inhibitor such as chloride, bromides, iodides, benzimidazoles, benzothiazoles and mercapto compounds. If desired, the color developer may further contain various preservatives such as hydroxylamine, hydroxylamines represented by the general formula (I) in JP-A-3-144446, diethylhydroxylamine, sulfites, hydrazines (e.g., N,N-biscarboxymethylhydrazine ), phenylsemicarbazides, triethanolamine and catecholsulfonic acids, organic solvents such as ethylene glycol and diethylene glycol, development accelerators such as benzyl alcohol, polyethylene glycol, quaternary ammonium salts, and amines, color-forming couplers, competing couplers, auxiliary developing agents such as 1-phenyl-3-pyrazolidone, viscosity-imparting agents, various chelating agents exemplified by aminopolycarboxylic acids, aminopolyphosphoric acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof).

Most preferred among these preservatives are substituted hydroxylamines. Particularly preferred among these substituted hydroxylamines are those having as a substituent an alkyl group substituted by sulfo group, carboxyl group or water-soluble group such as hydroxyl group. The most preferred examples of the substituted hydroxylamine include N,N-bis(2-sulfoethyl)hydroxylamine and alkaline metal salts thereof.

As the chelating agent there may be preferably used a biodegradable compound. Examples of the chelating agent compound include those described in JP-A-63-146998, JP-A-63-199295, JP-A-63-267750, JP-A-63-267751, JP-A-2-229146, JP-A-3-186841, German Patent 3,739,610, and EP 468325.

The color developer replenisher tank and the processing solution tank are preferably shielded by a liquid agent such as high boiling organic solvent to reduce the area in contact with air. The most preferred liquid shielding agent is liquid paraffin. In particular, the shielding agent is preferably used for replenisher tanks.

The temperature at which the processing is effected with the color developer of the present invention is in the range of 20 to 55° C., preferably 30 to 55° C. The processing time with photographic light-sensitive material for picture taking is in the range of 20 seconds to 5 minutes, preferably 30 seconds to 3 minutes and 20 seconds, more preferably 40 seconds to 2 minutes and 30 seconds. The processing time with printing photographic light-sensitive material is in the range of 10 seconds to 1 minute and 20 seconds, preferably 10 seconds to 60 seconds, more preferably 10 seconds to 40 seconds.

Reversal processing is usually carried out by black-and-white development followed by color development. Black-and-white developers to be used can contain one or more of known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

The color developer or black-and-white developer usually has a pH of from 9 to 12. The replenishment rate of the developer is usually 3 ℓ or less per $m^2$ of the light-sensitive material, though depending on the type of the color photographic material to be processed. The replenishment rate may be reduced to 500 mℓ/$m^2$ or less by decreasing the bromide ion concentration in the replenisher. If the replenishment rate is reduced, the area of the processing tank in contact with air is preferably reduced to inhibit the evaporation and air oxidation of the processing solution.

The area of the photographic processing solution in contact with air in the processing tank can be represented by an opening value as defined by the following equation:

$$\text{Opening value} = [\text{area of processing solution in contact with air } (cm^2)]/[\text{volume of processing solution } (cm^3)]$$

The opening value as defined above is preferably in the range of 0.1 or less, more preferably 0.001 to 0.05. Examples of methods for reducing the opening value include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening value is preferably effected in both color development and black-and-white development steps as well as all the subsequent steps such as bleach, blix, fixing, rinse and stabilization. The replenishment rate can also be reduced by a means for suppressing accumulation of the bromide ion in the developing solution.

The photographic emulsion layer which has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of polyvalent metals, e.g., iron (III), peroxides, quinones, and nitro compounds. Typical examples of these bleaching agents are organic complex salts of iron (III), e.g., with aminopolycarboxylic acids such as ethylenediaminetetraacetic acid, diethylenetriaminepentaacetic acid, cyclohexanediaminetetraacetic acid, methyliminodiacetic acid, glycoletherdiamine tetraacetic acid, bleaching agents such as 1,3-propylenediaminetetraacetic iron complex described in JP-A-4-121739, lower right column, page 4, to upper left column, page 5, carbamoyl bleaching agents as described in JP-A-4-73647, bleaching agents having heterocyclic group described in JP-A-4-174432, bleaching agents such as N-(2-carboxyphenyl)iminodiacetic ferric complex described in EP-A-520457, bleaching agents such as ethylenediamine-N-2-carboxyphenyl-N,N',N'-triacetic ferric complex described in Japanese Patent Application No. 3-252775, bleaching agents described in EP 501479, bleaching agents described in JP-A-4-127145, and ferric aminopolycarboxylate or salts thereof described in JP-A-3-144446, page (11).

Organic aminopolycarboxylic acid-iron (III) complex salts are useful in both of a bleaching solution and a blix solution. The pH value of a bleaching solution or blix solution comprising such an aminopolycarboxylic acid-iron complex salts is normally in the range of 4.0 to 8. For speeding up of processing, the processing can be effected at an even lower pH value.

The bleaching process is preferably effected immediately after color development. In the case of reversal processing, it is normally effected via adjustment (or bleach acceleration), etc. The adjustment bath may contain an image stabilizer as described later.

In the present invention, the desilvering bath may comprise the foregoing bleaching agents as well as rehalogenating agents as described in the above cited JP-A-3-144446, page (12), pH buffers and known additives, aminopolycarboxylic acids, organic phosphonic acids, etc.

The bleaching bath, blix bath or a prebath thereof can contain various bleaching accelerators. Examples of bleaching accelerators employable in the present invention include compounds containing a mercapto group or a disulfide group as described in U.S. Pat. No. 3,893,858, German Patent 1,290,812, British Patent 1,138,842, JP-A-53-95630, and Research Disclosure No. 17129 (July 1978), thiazolidine derivatives as described in JP-A-50-140129, thiourea derivatives as described in U.S. Pat. No. 3,706,561, iodides as described in JP-A-58-16235, polyoxyethylene compounds as described in German Patent 2,748,430, and polyamine compounds as described in JP-B-45-8836. Further, compounds as described in U.S. Pat. No. 4,552,834 are preferred. These bleaching accelerators may be incorporated into the light-sensitive material. These bleaching accelerators are particularly effective for blix of color light-sensitive materials for picture taking. In particular, mercapto compounds as described in British Patent 1,138,842, and JP-A-2-190856 are preferred.

The bleaching solution or blix solution preferably contains an organic acid besides the above mentioned compounds for the purpose of inhibiting bleach stain. A particularly preferred organic acid is a compound with an acid dissociation constant (pKa) of 2 to 5.5. In particular, dibasic acids are preferred. Specific examples of organic monobasic acids include acetic acid, propionic acid, hydroxyacetic acid, etc. Specific examples of organic dibasic acids include succinic acid, glutaric acid, maleic acid, fumaric acid, malonic acid, and adipic acid. Most preferred among these organic dibasic acids are succinic acid, glutaric acid, and maleic acid.

The total time required for desilvering step is preferably as short as possible so long as no desilvering occurs. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can be effectively inhibited.

The processing solution having bleaching capacity of the present invention is preferably aerated upon processing to provide extreme stabilization of photographic properties. Aeration can be effected by a means known in the art. For example, air may be blown through the processing solution having bleaching capacity. Alternatively, an ejector may be utilized to absorb air.

In the case where air is blown through the processing solution, air is preferably released into the processing solution through an air diffuser pipe having fine pores. Such an air diffuser pipe is widely used in an aeration tank for the treatment of activated sludge. For the details of aeration, reference can be made to Eastman Kodak's technical bulletin Z-121, Using Process C-41, 3rd edition, 1982, pp. BL-1 to BL-2. In the processing with the processing solution having bleaching capacity of the present invention, agitation is preferably intensified. For the implementation of this process, reference can be made to JP-A-3-33847, line 6, upper right column to line 2, lower left column, page 8.

In the desilvering step, the agitation is preferably intensified as much as possible. Specific examples of such an agitation intensifying method include a method as described in JP-A-183460 which comprises jetting the processing solution to the surface of the emulsion layer in the light-sensitive material, a method as described in JP-A-62-183461 which comprises improving the agitating effect by a rotary means, a method which comprises improving the agitating effect by moving the light-sensitive material with the emulsion surface in contact with a wiper blade provided in the bath so that a turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the light-sensitive material of the present invention is preferably equipped with a light-sensitive material conveying means as disclosed in JP-A-60-191257, 60-191258, and 60-191259. Such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

The overflow solution produced from the processing with the processing solution having bleaching capacity of the present invention may be recovered, modified with necessary components for correct composition, and then re-used. This process is normally called regeneration. In the present invention, such regeneration is preferably effected. For the details of regeneration, reference can be made to "Fuji Film Processing manual-Fuji Color Negative Film; CN-16 Processing", Fuji Film Co., Ltd., Aug. 1990, pp. 39–40.

The kit for adjusting the processing solution having bleaching capacity of the present invention may be used in the form of liquid or powder. Since the most materials except ammonium salts are supplied in the form of powder which absorbs less moisture, the kit can be easily prepared in the form of powder.

The foregoing kit for regeneration is preferably supplied in the form of powder which can be added as it is without any extra water in the light of reduction of the amount of waste liquid.

The regeneration of the processing solution having bleaching capacity can be accomplished by the foregoing aeration as well as method described in "Shashin Kogaku no Kiso-Ginenshashinhen (Fundamentals of Photographic Engineering—Silver Salt Photograph)", Society of Photographic Science and Technology of Japan, Corona, 1979. In some detail, the bleaching solution can be electrolytically regenerated. Alternatively, the bleaching solution can be regenerated with bromic acid, chlorous acid, bromine, bromine precursor, persulfate, hydrogen peroxide, hydrogen peroxide utilizing a catalyst, bromous acid, ozone, etc.

In the electrolytic regeneration, a cathode and an anode may be dipped in the same bleaching bath. Alternatively, the regeneration may be effected with the anode bath and cathode bath being partitioned by a membrane. Further, the bleaching solution and developer and/or fixing solution may be simultaneously regenerated in a system using a membrane.

The regeneration of the fixing solution or blix solution can be accomplished by the electrolytic reduction of silver ions accumulated. Further, halogen ions accumulated are preferably removed by an anion exchange resin to maintain the desired fixing capacity.

In order to reduce the required amount of rinsing water, ion exchanging or ultrafiltration may be employed. In particular, ultrafiltration is preferred.

It is usual that the thus desilvered photographic light-sensitive material of the invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counter-flow system or forward-flow system), and other various factors. Of these factors, the relationship between the number of washing tanks and the quantity of water in a multistage counter-flow system can be obtained according to the method described in "Journal of the Society of Motion Picture and Television Engineers", vol. 64, pp. 248–253 (May 1955). According to the multistage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku" (1986), Eisei Gijutsu Gakkai (ed.), "Biseibutsu no mekkin, sakkin, bobigijutsu" (1982), and Nippon Bokin Bobi Gakkai (ed.), "Bokin bobizai jiten" (1986).

The washing water has a pH value of from 4 to 9, preferably from 5 to 8. The temperature of the water and the washing time can be selected from broad ranges depending on the characteristics and end use of the light-sensitive material, but usually ranges from 15 to 45° C. in temperature and from 20 seconds to 10 minutes in time, preferably from 25 to 40° C. in temperature and from 30 seconds to 5 minutes in time. The light-sensitive material of the invention may be directly processed with a stabilizer in place of the washing step. For the stabilization, any of the known techniques as described in JP-A-57-8543, 58-14834, and 60-220345 can be used.

The stabilizing solution may contain a compound for stabilizing dye image, such as formalin, benzaldehyde such as m-hydroxybenzaldehyde, formaldehyde-bisulfurous acid adduct, hexamethylenetetramine and derivatives thereof, hexahydrotriazine and derivatives thereof, dimethylolurea, N-methylol compound such as N-methylolpyrazole, organic acid, and pH buffer. The added amount of such a compound is preferably in the range of 0.001 to 0.02 mol per ℓ of stabilizer. The concentration of free formaldehyde in the stabilizer is preferably kept low to minimize the scattering of formaldehyde. In this respect, as the dye image stabilizer there may be preferably used hydroxybenzaldehyde, hexamethylenetetramine, N-methylolazoles such as N-methylolpyrazole as described in JP-A-4-270344, azolylmethylamines such as N,N'-bis(1,2,4-triazole-1-ylmethyl) piperazine as described in JP-A-4-313753, etc. In particular, the combined use of azoles such as 1,2,4-triazole as described in JP-A-4-359249 and azolylmethylamine such as 1,4-bis(1,2,4-triazole-1-ylmethyl) and its derivatives advantageously provides a high image stability and a low formaldehyde vapor pressure. The stabilizer may further contain an ammonium compound such as ammonium chloride and ammonium sulfite, compound of metal such as Bi and Al, fluorescent brightening agent, hardener, alkanolamine described in U.S. Pat. No. 4,786,583, preservative which can be incorporated in the foregoing fixing solution or blix solution, such as sulfinic acid as described in JP-A-1-231051, etc.

The rinsing water and stabilizer may contain various surface active agents to inhibit uneven distribution of water droplets during the drying of the photographic light-sensitive material which has been processed. In particular, nonionic surface active agents are preferred. Particularly preferred among these nonionic surface active agents is alkylphenol-ethylene oxide adduct. As the alkylphenol there is preferably used octyl, nonyl, dodecyl, dinonylphenol or the like. The number of mol of ethylene oxide to be added is preferably in the range of 8 to 14. Further, a silicone surface active agent having a high antifoaming effect can be preferably used.

The rinsing water and stabilizer preferably contains various chelating agents. Preferred examples of these chelating agents include aminopolycarboxylic acids such as ethylenediaminetetraacetic acid and diethylenetriaminepentaacetic acid, organic phosphonic acids such as 1-hydroxyethylidene-1,1-diphosphonic acid, N,N,N'-trimethylenephosphonic acid and diethylenetriamine-N,N,N',N'-tetramethylenephosphonic acid, and hydrolyzate of anhydrous maleic polymers as described in EP 345,172A1.

The overflow accompanying replenishment of the washing bath and/or stabilizing both can be reused in other steps such as desilvering.

In a processing using an automatic developing machine, if the above mentioned various processing solutions are subject to concentration due to evaporation, the concentration due to evaporation is preferably corrected for by the addition of a proper amount of water, correcting liquid or processing replenisher. The method for the replenishment with water is not specifically limited. In particular, a method described in JP-A-1-254959 and JP-A-1-254960 which comprises replenishing the bleaching bath with water in proportion to the evaporation loss of water in the bleaching bath calculated from the evaporation loss of water determined in a monitor water bath provided separately of the bleaching bath is preferred. Further, an evaporation correction method using a liquid level sensor or overflow sensor as described in JP-A-3-248155, JP-A-3-249644, JP-A-3-249645, and JP-A-3-249646 is preferred. As the water for correcting for the evaporation loss of the various processing solutions there may be used tap water. Deionized water or sterilized water which can be preferably used in the foregoing rinsing step is preferred.

The various processing solutions of the present invention are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

In the present invention, the various processing solutions can be commonly used for the processing of two or more photographic light-sensitive materials. For example, the same processing solution can be used for the processing of color negative film and color paper, enabling the reduction of the cost of processing machine or the simplification of the processing.

The silver halide photographic material of the present invention can also be applied to heat-developable photographic light-sensitive materials as described in U.S. Pat. No. 4,500,626, JP-A-60-133449, JP-A-59-218443, JP-A-61-238056, and EP 210,660A2.

The present invention will be further described in the following examples, but the present invention should not be construed as being limited thereto.

EXAMPLE 1

Preparation of Emulsion 1 (Comparative)

Into a reaction vessel was charged 1,200 mℓ of an aqueous solution of gelatin containing 28 g of gelatin, 4.0 g of NaCl and 3.2 mℓ of N,N'-dimethylimidazoline-2-thion (1% aqueous solution). To the material were then added 200.0 mℓ of an aqueous solution of $AgNO_3$ (containing 32.0 g of $AgNO_3$) and 200.0 mℓ of an aqueous solution of NaCl (containing 1.0 g of NaCl) with stirring at a temperature of 52° C. in 24 minutes (Step A).

To the mixture was then added a thiosulfonic compound as shown later (Compound (I)) in an amount of $4.2\times10^{-4}$ mol. To the mixture were then added 526.7 my of an aqueous solution of $AgNO_3$ (containing 158.0 g of $AgNO_3$) and 526.7 mℓ of an aqueous solution of NaCl (containing 154.4 g of NaCl) while the temperature thereof being kept to 52° C. in 26 minutes and 20 seconds (Step B).

The solution was then kept at a temperature of 52° C. for 15 minutes. The solution was allowed to cool to a temperature of 35° C. where it was then desalted and rinsed by an ordinary method.

The properties of Emulsion 1 thus obtained are set forth in Table 2.

Preparation of Emulsion 2 (Comparative: KBr Conversion)

Emulsion 2 was prepared in the same manner as Emulsion 1 except that the addition of an aqueous solution of $AgNO_3$ and an aqueous solution of NaCl at Step B was followed by the addition of 32.0 mℓ of an aqueous solution of KBr (containing 0.8 g of KBr) in 6 minutes.

The properties of Emulsion 2 thus obtained are set forth in Table 2.

Preparation of Emulsion 3 (Comparative: KI Conversion)

Emulsion 3 was prepared in the same manner as Emulsion 2 except that 32.0 mℓ of an aqueous solution of KI (containing 1.1 g of KI) was added instead of the aqueous solution of KBr.

The properties of Emulsion 3 thus obtained are set forth in Table 2.

Preparation of Emulsion 4 (Comparative: Finely Divided AgBr Grains Added)

Emulsion 4 was prepared in the same manner as Emulsion 1 except that Step B was partially altered as follows:$AgNO_3$) and 523.0 mℓ of an aqueous solution of NaCl (containing 154.4 g of NaCl) were then added to the mixture while the temperature thereof being kept to 52° C. in 26 minutes and 9 seconds. Subsequently, to the mixture was then added finely divided AgBr grains as described later in an amount of $6.6\times10^{-3}$ mol as calculated in terms of Ag. The emulsion thus obtained was then ripened for 5 minutes.

The properties of Emulsion 4 thus obtained are set forth in Table 2.

Preparation of Finely Divided AgBr Grains

Into a reaction vessel was charged 1,200 mℓ of an aqueous solution of gelatin (containing 24 g of gelatin having an average molecular weight of 30,000 (hereinafter referred to as "M3 gelatin" and 0.09 g of KBr; pH 3.0). To the material were then added 240.0 mℓ of an aqueous solution of $AgNO_3$ (containing 60.0 g of $AgNO_3$, 2.0 g of M3 gelatin and 1.0 mℓ of 1M $HNO_3$) and 240.0 mℓ of an aqueous solution of KBr (containing 42.0 g of KBr, 2.0 g of M3 gelatin and 1.0 mℓ of 1M KOH) by a double jet process at a rate of 90 cc/min. with stirring at a temperature of 23° C. in 2 minutes and 40 seconds. The emulsion was further stirred for 30 seconds. The emulsion was then adjusted to pH 4.0 and pBr 3.2.

The finely divided AgBr grains thus obtained had an average grain diameter of 0.04 μm in sphere equivalent.

Preparation of Emulsion 5 (Comparative: Finely Divided AgI Grains Added)

Emulsion 5 was prepared in the same manner as Emulsion 4 except that finely divided AgI grains were added in the equimolecular amount instead of the finely divided AgBr grains.

The properties of Emulsion 5 thus obtained are set forth in Table 2.

Preparation of Finely Divided AgI Grains

Into a reaction vessel was charged 1,200 mℓ of an aqueous solution of gelatin (containing 24 g of M3 gelatin, 4.9 g of KBr and 0.4 g of KI; pH 3.0). To the material were then added 240.0 mℓ of an aqueous solution of $AgNO_3$ (containing 60.0 g of $AgNO_3$, 2.0 g of M3 gelatin and 1.0 mℓ of 1M $HNO_3$) and 240.0 mℓ of an aqueous solution of NaCl (containing 20.7 g of KI, 2.0 g of M3 gelatin and 1.0 mℓ of 1M KOH) by a double jet process at a rate of 90 cc/min. with stirring at a temperature of 23 ° C. in 2 minutes and 40 seconds. The emulsion was further stirred for 30 seconds. The emulsion was then adjusted to pH 4.0 and pBr 2.3.

The finely divided AgI grains thus obtained had an average grain diameter of 0.03 μm in sphere equivalent.

Preparation of Emulsion 6 (Comparative: $Br^-$ Releasing Agent)

Emulsion 6 was prepared in the same manner as Emulsion 2 except that $6.6\times10^{-3}$ mol of ethyl bromoacetate was added and ripened for 10 minutes instead of the addition of an aqueous solution of KBr over 6 minutes.

The properties of Emulsion 6 thus obtained are set forth in Table 2.

Preparation of Emulsion 7 (Comparative: $I^-$-Releasing Agent)

Emulsion 7 was prepared in the same manner as Emulsion 6 except that the ripening with ethyl bromoacetate for 10 minutes was altered as follows:

The temperature of the emulsion was lowered to 55° C. To the emulsion was then added 2-iodoethanol (0.5 mℓ). The emulsion was adjusted with a 0.1 M aqueous solution of NaOH to pH 10.5 where it was then kept for 2 minutes so that iodide ions were suddenly produced. The pH value of the emulsion was then lowered back to 5.0.

The properties of Emulsion 7 thus obtained are set forth in Table 2.

Preparation of Emulsion 8 (Comparative)

Into a reaction vessel was charged 1,200 mℓ of an aqueous solution of gelatin (containing 18.0 g of gelatin; pH 4.3). To the material were then added 12.0 mℓ of an aqueous solution of $AgNO_3$ (containing 2.40 g of $AgNO_3$) and 12.0 mℓ of an aqueous solution of NaCl (containing 0.83 g of NaCl) by a double jet process at a rate of 24 mℓ/min. with stirring at a temperature of 45° C. The mixture was then stirred for 1 minute. To the mixture were then added 19.0 mℓ of an aqueous solution of $AgNO_3$ (containing 0.38 g of $AgNO_3$) and 19.0 mℓ of an aqueous solution of KBr (containing 0.27 g of KBr) by a double jet process at a rate of 30 mℓ/min. with stirring. The mixture was then stirred for 1 minute. To the mixture were then added 36.0 mℓ of an aqueous solution of $AgNO_3$ (containing 7.20 g of $AgNO_3$) and 36.0 mℓ of an aqueous solution of NaCl (containing 2.48 g of NaCl) by a double jet process at a rate of 48 mℓ/min. with stirring. The emulsion was then adjusted with 20.0 mℓ of an aqueous solution of NaCl (containing 2.0 g of NaCl) to pH 4.8 (Step A).

To the mixture was then added the foregoing thiosulfonic compound (Compound (I)) in an amount of $4.2\times10^{-4}$ mol. The mixture was heated to a temperature of 70° C. where it was then ripened for 16 minutes. To the emulsion was then added finely divided AgCl grains described later in an amount of 1.0 mol as calculated in terms of Ag. The emulsion was then ripened for 35 minutes (Step B).

The emulsion was allowed to cool to a temperature of 35° C. where it was then rinsed by an ordinary sedimentation method. To the emulsion was then added an aqueous solution of gelatin. The emulsion was then heated to a temperature of 40° C. so that it was adjusted to pH 6.4 and pCl 2.8.

The properties of Emulsion 8 are set forth in Table 2.

Preparation of Finely Divided AgCl Grains

Into a reaction vessel was charged 1,200 mℓ of an aqueous solution of gelatin (containing 24 g of M3 gelatin and 0.5 g of NaCl; pH 3.0). To the material were then added 900.0 mℓ of an aqueous solution of $AgNO_3$ (containing 225.0 g of $AgNO_3$, 9.0 g of M3 gelatin and 2.3 mℓ of 1M $HNO_3$) and 900.0 mℓ of an aqueous solution of NaCl (containing 77.4 g of NaCl, 9.0 g of M3 gelatin and 2.3 mℓ of 1M KOH) by a double jet process at a rate of 90 mℓ/min. with stirring at a temperature of 23° C. in 10 minutes. The emulsion was then stirred for 30 seconds. The emulsion was then adjusted to pH 4.0 and pCl 1.7.

The finely divided AgCl grains thus obtained had an average grain diameter of 0.06 μm in sphere equivalent.

Preparation of Emulsion 9 (Present Invention: KBr Aqueous Solution Added)

Emulsion 9 was prepared in the same manner as Emulsion 8 except that the ripening with finely divided AgCl grains for 35 minutes was followed by the addition of 32.0 mℓ of an aqueous solution of KBr (containing 1.6 g of KBr) in 6 minutes in Step B.

The properties of Emulsion 9 thus obtained are set forth in Table 2.

Preparation of Emulsion 10 (Present Invention: KI Aqueous Solution Added)

Emulsion 10 was prepared in the same manner as Emulsion 9 except that 32.0 g mℓ of an aqueous solution of KI (containing 2.2 g of KI) was added instead of the aqueous solution of KBr.

The properties of Emulsion 10 thus obtained are set forth in Table 2.

Preparation of Emulsion 11 (Present Invention: Finely Divided AgBr Grains Added)

Emulsion 11 was prepared in the same manner as Emulsion 8 except that Step B was partially altered as follows:

The emulsion was ripened at a temperature of 70° C. for 16 minutes. The emulsion was then ripened with finely divided AgCl grains in an amount of 0.987 mol as calculated in terms of Ag for 35 minutes. The emulsion was further ripened with finely divided AgBr grains in an amount of 0.013 mol as calculated in terms of Ag for 6 minutes.

The properties of Emulsion 11 thus obtained are set forth in Table 2.

Preparation of Emulsion 12 (Present Invention: Finely Divided AgI Grains Added)

Emulsion 12 was prepared in the same manner as Emulsion 11 except that finely divided AgI grains were added in the equimolecular amount instead of the finely divided AgBr grains.

The properties of Emulsion 12 thus obtained are set forth in Table 2.

Preparation of Emulsion 13 (Present Invention: $Br^-$-Releasing Agent)

Emulsion 13 was prepared in the same manner as Emulsion 8 except that the ripening with finely divided AgCl grains for 35 minutes was followed by the ripening with 0.013 mol of ethyl bromoacetate for 10 minutes in Step B.

The properties of Emulsion 13 thus obtained are set forth in Table 2.

Preparation of Emulsion 14 (Present Invention: $I^-$-Releasing Agent)

Emulsion 14 was prepared in the same manner as Emulsion 13 except that the ripening with 0.013 mol of ethyl bromoacetate for 10 minutes was altered as follows:

The emulsion was ripened with finely divided AgCl grains for 35 minutes. The temperature of the emulsion was then lowered to 55° C. To the emulsion was then added 2-iodoethanol (1.0 cc). The emulsion was adjusted with a 0.1 M aqueous solution of NaOH to pH 10.5 where it was then kept for 2 minutes so that iodide ions were suddenly produced. The pH value of the emulsion was then lowered back to 5.0.

The properties of Emulsion 14 thus obtained are set forth in Table 2.

Preparation of Emulsion 15 (Present Invention)

Emulsion 15 was prepared in the same manner as Emulsion 14 except that the thiosulfonic compound was not added.

Emulsions 1 to 15 thus obtained were then subjected to chemical sensitization at a temperature of 60° C., pH 6.2 and pAg 8.4 in the following manner.

To each of these emulsions was added thiourea dioxide. These emulsions were then allowed to stand for 16 minutes so that they were subjected to reduction sensitization. To each of these emulsions was then added a sensitizing dye (Compound (II)) as shown later.

These emulsions were each then subjected to ripening with potassium thiocyanate, potassium chloroaurate, sodium thiosulfate and a selenium sensitizer (Compound (III)) as shown later.

The amount of the various compounds added during the chemical sensitization and the ripening time were adjusted such that the sensitivity obtained with 1/100 second exposure reached an optimum value.

Emulsion 16 was prepared by subjecting Emulsion 14 to the foregoing chemical sensitization free from selenium sensitizer.

TABLE 2

| Emulsion | Grain form | Average grain diameter in sphere equivalent (μm) | Proportion of grains having an aspect ratio of 2 to 15 (%) | Intergrain unifomity of difficultly-soluble silver salt: % Ratio of grains in the range of 0.8 $Z_0$ to 1.2 $Z_0$ | Intergrain unifomity of difficultly-soluble silver salt: % Ratio of grains in the range of 0.9 $Z_0$ to 1.1 $Z_0$ |
|---|---|---|---|---|---|
| 1 | Cube | 0.98 | 0 | — | — |
| 2 | " | 1.00 | 0 | 90 | 80 |
| 3 | " | 0.97 | 0 | 90 | 75 |
| 4 | " | 0.98 | 0 | 98 | 92 |
| 5 | " | 0.99 | 0 | 95 | 90 |
| 6 | " | 0.99 | 0 | 98 | 94 |
| 7 | " | 0.97 | 0 | 96 | 92 |
| 8 | Tablet | 0.98 | 86 | — | — |
| 9 | " | 0.98 | 86 | 55 | 35 |
| 10 | " | 0.97 | 86 | 50 | 30 |
| 11 | " | 0.99 | 85 | 92 | 88 |
| 12 | " | 0.98 | 86 | 92 | 86 |
| 13 | " | 0.98 | 87 | 94 | 90 |
| 14 | " | 0.98 | 86 | 92 | 88 |
| 15 | " | 0.98 | 86 | 92 | 88 |

(Specimens 1 to 8 are comparative while the others are according to the present invention)

To each of the emulsions which had been subjected to chemical sensitization was added the compounds as shown below. These emulsions were each applied to a triacetyl cellulose film support having an undercoat layer together with a protective layer in such an amount that the amount of silver reached 0.5 g/m$^2$ by the simultaneous extrusion method to obtain Specimens 1 to 16.

(1) Emulsion Layer

Emulsion . . . Emulsions 1 to 16

Compound 1 represented by the structural formula shown later

Tricresyl phosphate

Stabilizer: 4-Hydroxy-6-methyl-1,3,3a,7-tetrazaindene

Coating aid: Sodium dodecylbenzenesulfonate (2) Protective Layer

Finely divided grains of polymethyl methacrylate

Sodium salt of 2,4-dichloro-6-hydroxy-s-triazine

Gelatin

These specimens were each subjected to exposure for sensitometry (1/100 sec.), and then subjected to the following color development.

| (Processing step) Step | Processing time | Processing temperature |
|---|---|---|
| Color development | 45 sec. | 38° C. |
| Bleaching | 30 sec. | 38° C. |
| Fixing | 45 sec. | 38° C. |
| Stabilizing (1) | 20 sec. | 38° C. |
| Stabilizing (2) | 20 sec. | 38° C. |
| Stabilizing (3) | 20 sec. | 38° C. |
| Drying | 30 sec. | 60° C. |

*In the stabilizing step, a countercurrent process was used wherein the processing solution flows backward from (3) to (1).

The composition of the various processing solutions will be described below.

| | |
|---|---|
| **Color developer** | |
| Ethylenediaminetetraacetic acid | 3.0 g |
| Disodium 4,5-dihydroxybenzene-1,3-disulfonate | 0.3 g |
| Potassium carbonate | 30.0 g |
| Sodium chloride | 5.0 g |
| Disodium-N,N-bis(sulfonatoethyl) hydroxylamine | 6.0 g |
| 4-[N-ethyl-N-(β-hydroxylethyl)amino]-2-methylaniline sulfate | 5.0 g |
| Water to make | 1.0 l |
| pH adjusted with potassium hydroxide and sulfuric acid to | 10.00 |
| **Bleaching solution** | |
| Ferric ammonium 1,3-diaminopropane-tetracetate monohydrate | 140 g |
| 1,3-Diaminopropanetetraacetic acid | 3 g |
| Ammonium bromide | 80 g |
| Ammonium nitrate | 15 g |
| Hydroxyacetic acid | 25 g |
| 98% Acetic acid | 40 g |
| Water to make | 1.0 l |
| pH adjusted with aqueous ammonia and acetic acid to | 4.3 |
| **Fixing solution** | |
| Disodium ethylenediaminetetraacetate | 15 g |
| Ammonium sulfite | 19 g |
| Imidazole | 15 g |
| 70 wt. % Ammonium thiosulfate | 280 ml |
| Water to make | 1.0 l |
| pH adjusted with aqueous ammonia and acetic acid to | 7.4 |
| **Stabilizing solution** | |
| Sodium p-toluenesulfinate | 0.03 g |
| Polyoxyethylene-p-monononylphenylether (average polymerization degree: 10) | 0.2 g |
| Disodium ethylenediaminetetraacetate | 0.05 g |
| 1,2,4-Triazole | 1.3 g |
| 1,4-Bis(1,2,4-triazole-1-ylmethyl) piperazine | 0.75 g |
| Water to make | 1.0 l |
| pH adjusted with aqueous ammonia and acetic acid to | 8.5 |

The specimens which had been processed were each measured for density through a green filter.

The sensitivity was represented as the reciprocal of the exposure giving a density of fog plus 0.2, relative to the value of Specimen 1 as 100. The sensitivity and gradation values are set forth in Table 3.

TABLE 3

| Specimen No. | Emulsion No. | Presence of thio-sulfonic compound | Presence of selenium sensitization | Sensitivity | Gradation |
|---|---|---|---|---|---|
| 1 | 1 | Yes | Yes | 100 | 2.0 |
| 2 | 2 | " | " | 159 | 1.8 |
| 3 | 3 | " | " | 150 | 1.7 |
| 4 | 4 | " | " | 175 | 1.9 |
| 5 | 5 | " | " | 160 | 1.8 |
| 6 | 6 | " | " | 181 | 1.9 |
| 7 | 7 | " | " | 166 | 1.9 |
| 8 | 8 | " | " | 139 | 1.3 |
| 9 | 9 | " | " | 221 | 1.5 |
| 10 | 10 | " | " | 242 | 1.4 |
| 11 | 11 | " | " | 339 | 1.9 |
| 12 | 12 | " | " | 381 | 1.9 |
| 13 | 13 | " | " | 400 | 2.0 |

TABLE 3-continued

| Specimen No. | Emulsion No. | Presence of thio-sulfonic compound | Presence of selenium sensitization | Sensitivity | Gradation |
|---|---|---|---|---|---|
| 14 | 14 | " | " | 440 | 1.9 |
| 15 | 15 | No | " | 380 | 1.7 |
| 16 | 16 | Yes | No | 372 | 1.8 |

(Specimens 1 to 8 are comparative while the others are according to the present invention)

Table 3 shows that the tabulation of emulsion grains provides a higher sensitivity. It can also be seen in Table 3 that the presence of a silver salt more difficultly-soluble than silver chloride on the surface of tabular grains provides an even higher sensitivity. It can further be seen that if the difficultly soluble silver salt is formed uniformly from grain to grain, a higher contrast can be provided. This is thought to be because that the intergrain uniform formation of a difficultly soluble silver salt contributes to the uniformization of adsorption of sensitizing dye from grain to grain.

EXAMPLE 2

A multi-layer color light-sensitive material was prepared as Specimen 101 by coating on an undercoated cellulose triacetate film support various layers having the following compositions:

(Composition of Light-Sensitive Layer)

Materials to be incorporated in the various layers are classified into the following categories:

ExC: cyan coupler; ExM: magenta coupler; ExY: yellow coupler; ExS: sensitizing dye; UV: ultraviolet absorbent; HBS: high boiling organic solvent; H: gelatin hardener The figure accompanying each component indicates the coated amount thereof in g/m$^2$. The coated amount of silver halide is represented in g/m$^2$ as calculated in terms of silver. The coated amount of sensitizing dye is represented in the number of moles per mol of silver halide in the same layer.

| | |
|---|---|
| 1st layer: antihalation layer | |
| Black colloidal silver | 0.09 in silver equivalent |
| Gelatin | 1.30 |
| ExM-1 | 0.12 |
| ExF-1 | $2.0 \times 10^{-3}$ |
| Solid-dispersible dye ExF-2 | 0.030 |
| Solid-dispersible dye ExF-3 | 0.040 |
| HBS-1 | 0.15 |
| HBS-2 | 0.02 |
| 2nd layer: interlayer | |
| ExC-2 | 0.04 |
| Polyethyl acrylate latex | 0.20 |
| Gelatin | 1.04 |
| 3rd layer: low sensitivity red-sensitive emulsion layer | |
| Silver bromochloride emulsion A | 0.25 in silver equivalent |
| Silver bromochloride emulsion B | 0.25 in silver equivalent |
| ExS-1 | $6.9 \times 10^{-5}$ |
| ExS-2 | $1.8 \times 10^{-5}$ |
| ExS-3 | $3.1 \times 10^{-5}$ |
| ExC-1 | 0.17 |
| ExC-3 | 0.030 |
| ExC-4 | 0.10 |
| ExC-5 | 0.020 |
| ExC-6 | 0.010 |

-continued

| | |
|---|---|
| Cpd-2 | 0.025 |
| HBS-1 | 0.10 |
| Gelatin | 0.87 |
| 4th layer: middle sensitivity red-sensitive emulsion layer | |
| Silver bromochloride emulsion C | 0.70 in silver equivalent |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| 5th layer: high sensitivity red-sensitive emulsion layer | |
| Silver bromochloride emulsion D | 1.40 in silver equivalent |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| 6th layer: interlayer | |
| Cpd-1 | 0.090 |
| Solid-dispersible dye ExF-4 | 0.030 |
| HBS-1 | 0.050 |
| Polyethyl acrylate latex | 0.15 |
| Gelatin | 1.10 |
| 7th layer: low sensitivity green-sensitive emulsion layer | |
| Silver bromochloride emulsion E | 0.15 in silver equivalent |
| Silver bromochloride emulsion F | 0.10 in silver equivalent |
| Silver bromochloride emulsion G | 0.10 in silver equivalent |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| 8th layer: middle sensitivity green-sensitive emulsion layer | |
| Silver bromochloride emulsion H | 0.80 in silver equivalent |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.88 |

-continued

| | |
|---|---|
| 9th layer: high sensitivity green-sensitive emulsion layer | |
| Emulsion 1 (prepared in the present example) | 1.25 in silver equivalent |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl acrylate latex | 0.15 |
| Gelatin | 1.00 |
| 10th layer: yellow filter layer | |
| Yellow colloidal silver | 0.015 in silver equivalent |
| Cpd-1 | 0.16 |
| Solid-dispersible dye ExF-5 | 0.060 |
| Solid-dispersible dye ExF-6 | 0.060 |
| Oil-soluble dye ExF-7 | 0.010 |
| HBS-1 | 0.60 |
| Gelatin | 0.70 |
| 11th layer: low sensitivity blue-sensitive emulsion layer | |
| Silver bromochloride emulsion I | 0.09 in silver equivalent |
| Silver bromochloride emulsion J | 0.09 in silver equivalent |
| ExS-7 | $8.6 \times 10^{-4}$ |
| ExC-8 | $7.0 \times 10^{-3}$ |
| ExY-1 | 0.050 |
| ExY-2 | 0.73 |
| ExY-4 | 0.020 |
| Cpd-2 | 0.10 |
| Cpd-3 | $4.0 \times 10^{-3}$ |
| HBS-1 | 0.32 |
| Gelatin | 1.20 |
| 12th layer: high sensitivity blue-sensitive emulsion layer | |
| Silver bromochloride emulsion K | 1.00 in silver equivalent |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| 13th layer: 1st protective layer | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.2 |
| 14th layer: 2nd protective layer | |
| Silver chloride emulsion L | 0.10 in silver equivalent |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

In order to improve the preservability, processability, pressure resistance, mildew resistance, bacteria resistance, antistatic properties, and coating properties of the material, W-1 to W-3, B-4 to B-6, F-1 to F-17, iron salt, lead salt, gold salt, platinum salt, palladium salt, iridium salt, and rhodium salt were properly incorporated in the various layers.

TABLE 4

| Emulsion | Grain form | Silver chloride content (mol %) | Silver bromide localized on grain surface (mol %) | Average grain diameter in sphere equivalent (μm) |
|---|---|---|---|---|
| A | Rectangular, parallelogram, tabular | 99.2 | 0.8 | 0.46 |
| B | Rectangular, parallelogram, tabular | 99.2 | 0.8 | 0.57 |
| C | Rectangular, parallelogram, tabular | 99.3 | 0.7 | 0.66 |
| D | Rectangular, parallelogram, tabular | 99.5 | 0.5 | 0.84 |
| E | Rectangular, parallelogram, tabular | 99.2 | 0.8 | 0.46 |
| F | Rectangular, parallelogram, tabular | 99.3 | 0.7 | 0.57 |
| G | Rectangular, parallelogram, tabular | 99.2 | 0.8 | 0.61 |
| H | Rectangular, parallelogram, tabular | 99.2 | 0.8 | 0.61 |
| I | Rectangular, parallelogram, tabular | 99.2 | 0.2 | 0.46 |
| J | Rectangular, parallelogram, tabular | 99.3 | 0.7 | 0.64 |
| K | Rectangular, parallelogram, tabular | 99.6 | 0.4 | 1.28 |
| L | Cubic | 100.0 | 0.0 | 0.07 |

| Emulsion | Average aspect ratio | Grain diameter in terms of projected area (μm) | Grain size distribution fluctuation coefficient (%) |
|---|---|---|---|
| A | 5.5 | 0.56 | 15 |
| B | 4.0 | 0.78 | 20 |
| C | 5.8 | 0.87 | 25 |
| D | 3.7 | 1.03 | 26 |
| E | 5.5 | 0.56 | 15 |
| F | 4.0 | 0.78 | 20 |
| G | 4.4 | 0.77 | 23 |
| H | 4.4 | 0.77 | 23 |
| I | 4.2 | 0.5 | 15 |
| J | 5.2 | 0.85 | 23 |
| K | 3.5 | 1.46 | 26 |
| L | 1.0 | — | 15 |

In Table 4, (1) Emulsions I to K were subjected to reduction sensitization with thiourea dioxide and thiosulfonic acid in accordance with an example in JP-A-2-191938;

(2) Emulsions A to H were subjected to gold sensitization, sulfur sensitization and selenium sensitization in the presence of the spectral sensitizing dye as set forth with reference to the various light-sensitive layers and sodium thiocyanate in accordance with an example in JP-A-3-237450; and (3) The preparation of tabular grains was conducted in accordance with U.S. Pat. No. 5,264,337.

Preparation of Dispersion of Organic Solid-Dispersible Dye

ExF-2 as shown below was dispersed in the following manner. In some detail, 21.7 mℓ of water, 3 mℓ of a 5% aqueous solution of sodium p-octylphenoxyethoxyethoxyethanesulfonate, and 0.5 g of a 5% aqueous solution of p-octylphenoxypolyoxyethylene ether (polymerization degree: 10) were charged into a 700-mℓ pot mill. To the mixture were then added 5.0 g of ExF-2 and 500 mℓ of zirconium oxide beads (diameter: 1 mm). The content was then subjected to dispersion for 2 hours by means of a BO type oscillating ball mill available from Chuo Koki K.K. After dispersion, the content was withdrawn from the mill, and then added to 8 g of a 12.5% aqueous solution of gelatin. The beads were then removed by filtration to obtain a gelatin dispersion of dye. The finely divided dye grains had an average grain diameter of 0.44 μm.

Solid dispersions of ExF-3, ExF-4 and ExF-6 were obtained in the same manner as above. These solid dispersions comprised finely divided grains having an average grain diameter of 0.24 μm, 0.45 μm and 0.52 μm, respectively. ExF-5 was subjected to dispersion in accordance with a microprecipitation dispersion method as described in Example 1 of EP 549,489A. This dispersion comprised finely divided grains having an average grain size of 0.06 μm.

Specimens 102 to 116 were prepared in the same manner as Specimen 101 except that Emulsion 1 to be incorporated in the 9th layer (high sensitivity green-sensitive emulsion layer) was replaced by Emulsions 2 to 16, respectively. Specimens 101 to 116 thus obtained were each subjected to exposure for sensitometry (1/100 sec.), and then subjected to color development in the same manner as in Example 1.

The sensitivity and gradation at the foot of the characteristic curve of magenta dye of the present example showed the same effect as that obtained with the single layer specimen of Example 1.

EXAMPLE 3

Specimens 108, 110 and 114 were stored at a temperature of 40° C. and a relative humidity of 80% for 7 days, subjected to color development in the same manner as in Example 1, and then measured for magenta density.

The change in the reciprocal (logarithm) of the exposure giving an density of fog plus 0.2 from before to after storage was determined. As a result, Specimens 108, 110 and 114 exhibited −0.17, −0.19 and −0.03, respectively. In other words, it can be seen that the intergrain uniformization of formation of difficultly soluble silver salt exerts an effect of reducing desensitization due to storage.

In accordance with the present invention, an emulsion of high silver chloride content tabular grains having {100} planes as main planes which can be rapidly processed can provide an excellent color sensitization, gradation and preservability by uniformly forming a silver salt more difficultly soluble than silver chloride on the surface of the silver halide grains.

Compound (I)

$C_2H_5SO_2SNa$

Compound (II) Sensitizing dye

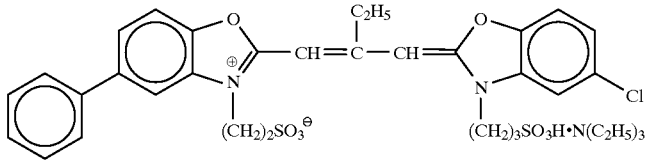

Compound (III) Selenium sensitizer

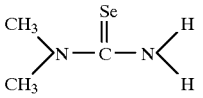

Compound 1

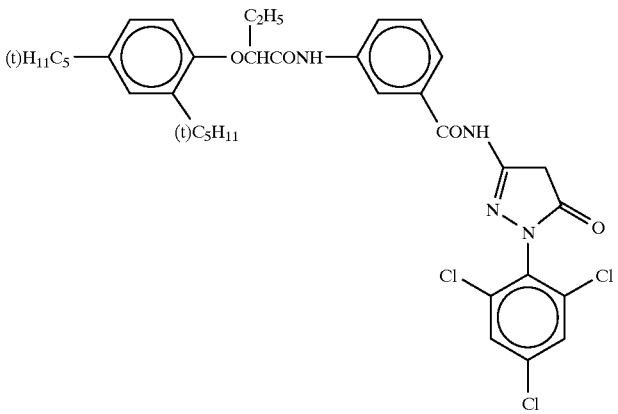

-continued
ExC-1
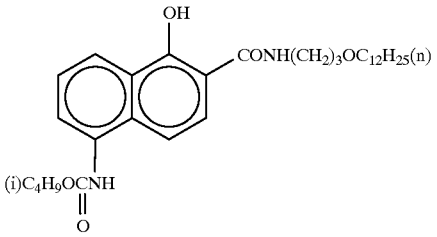
ExC-2
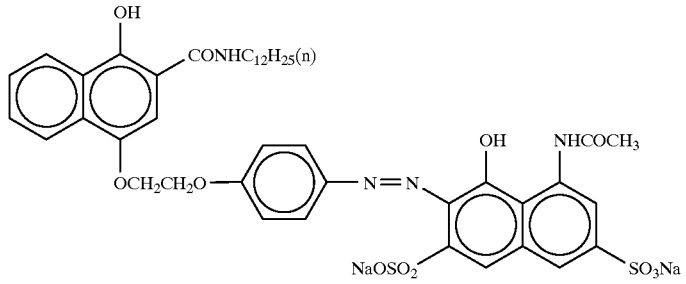
ExC-3
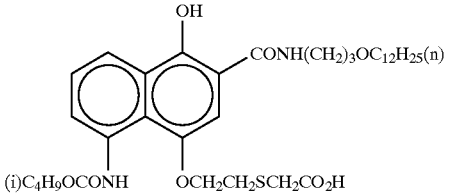
ExC-4
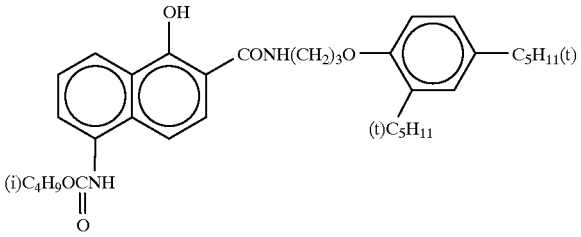
ExC-5
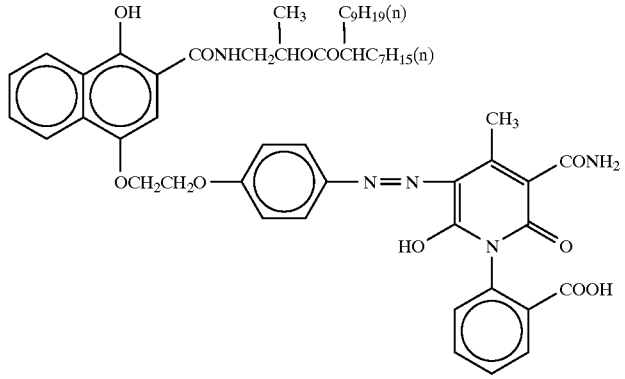

-continued
ExC-6
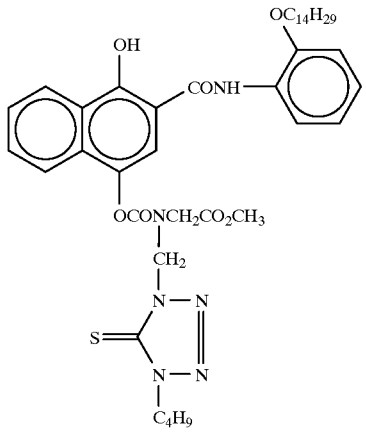
ExC-7
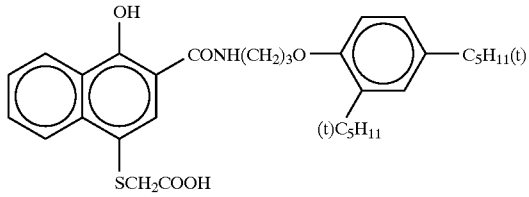
ExC-8
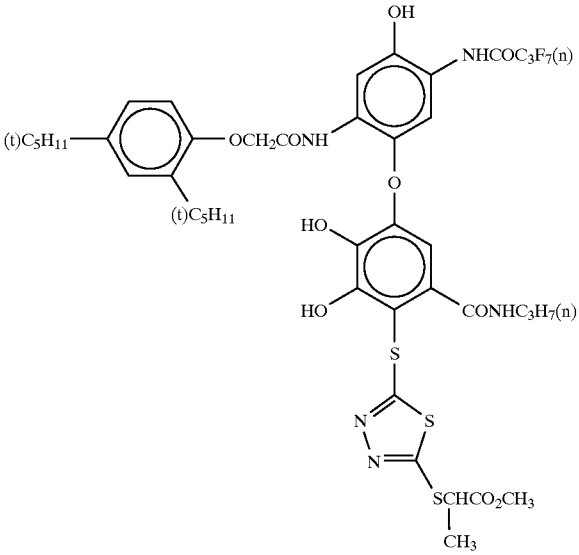
ExM-1
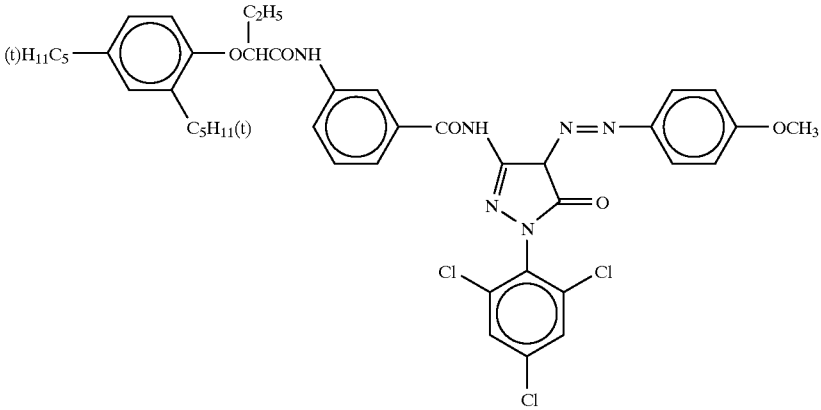

-continued
ExM-2
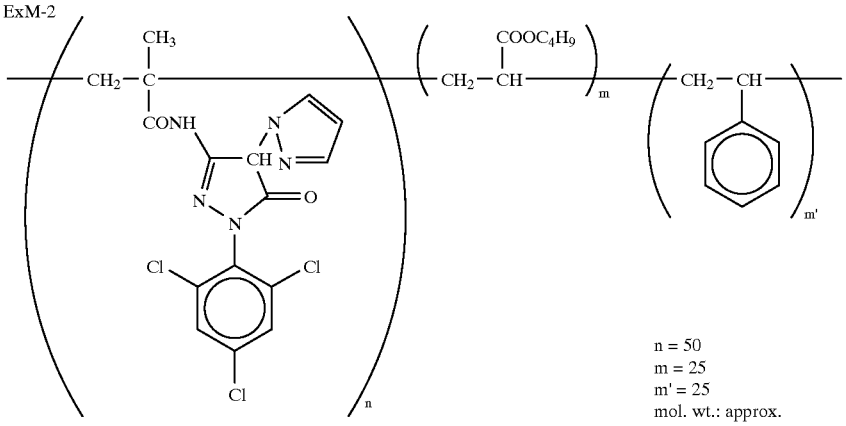
n = 50
m = 25
m' = 25
mol. wt.: approx. 20,000
ExM-3
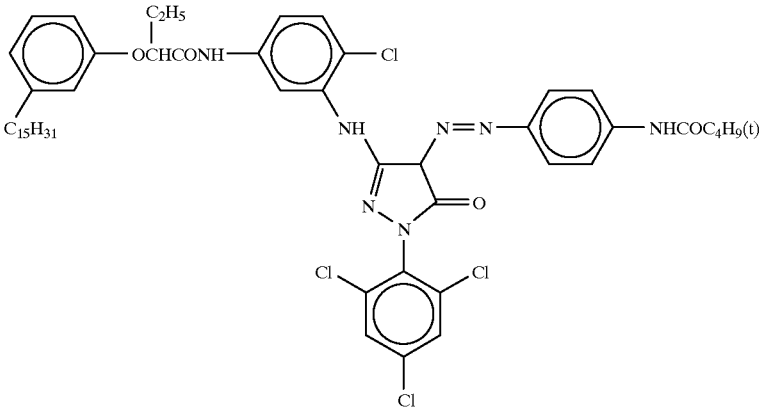
ExM-4
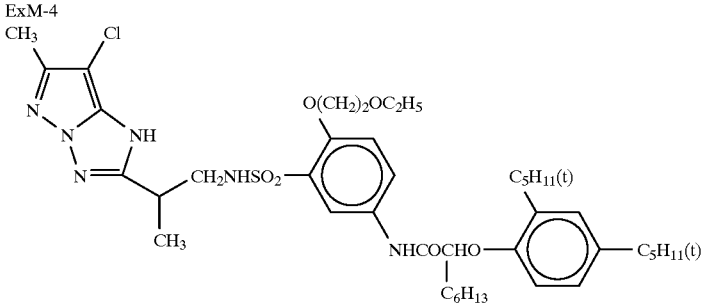
ExM-5
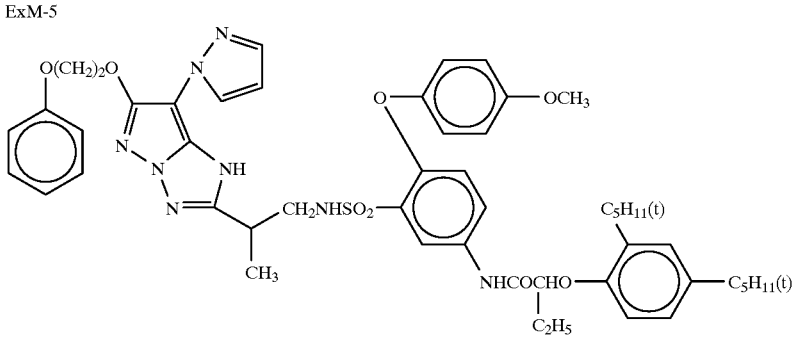

-continued
ExY-1
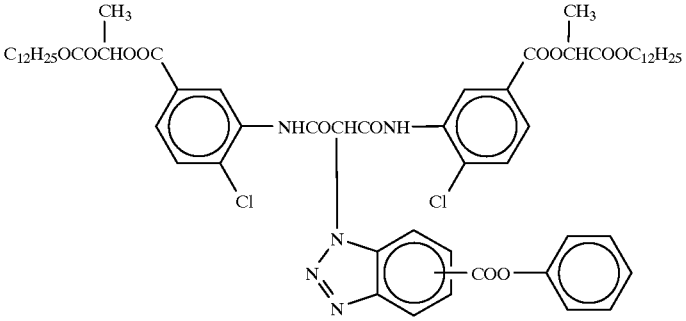
ExY-2
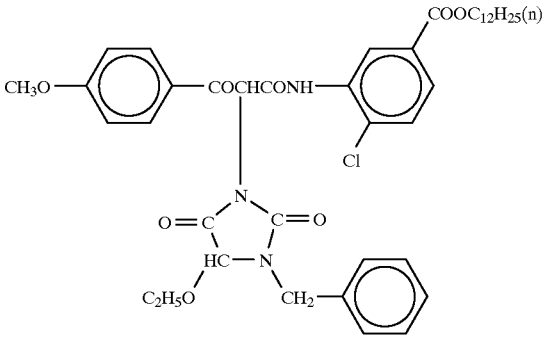
ExY-3
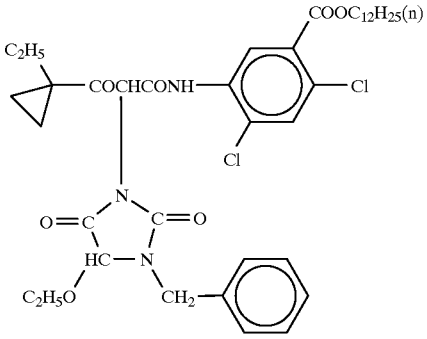
ExY-4
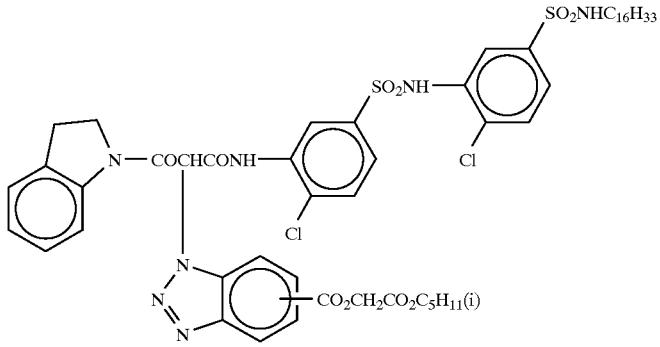

-continued
ExY-5
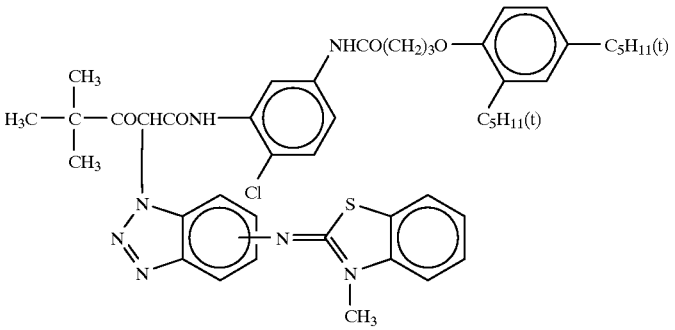
ExY-5
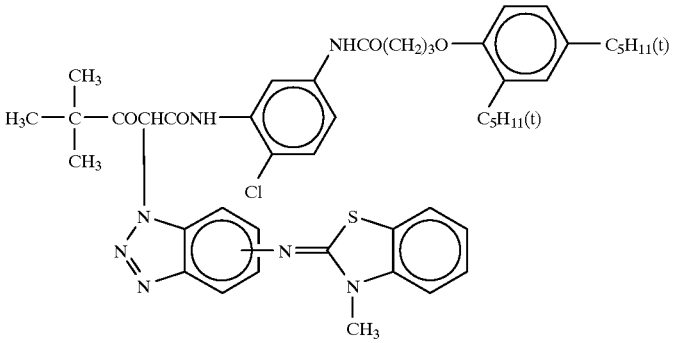
ExF-1
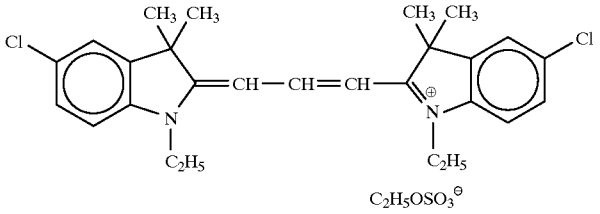
ExF-2
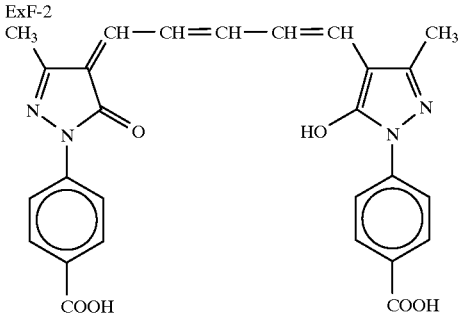
ExF-3
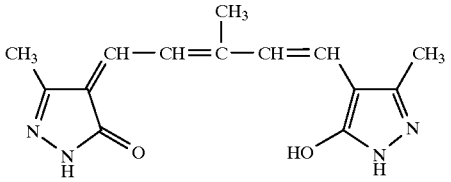

-continued
ExF-4
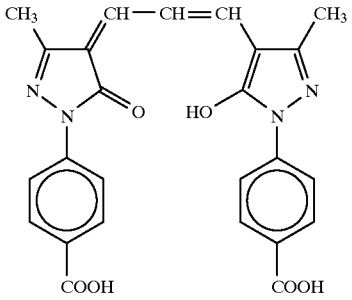
ExF-5
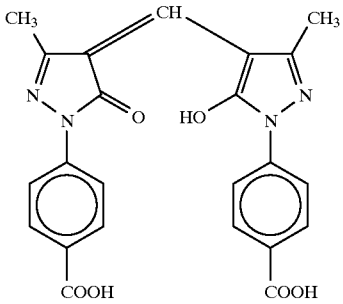
ExF-7
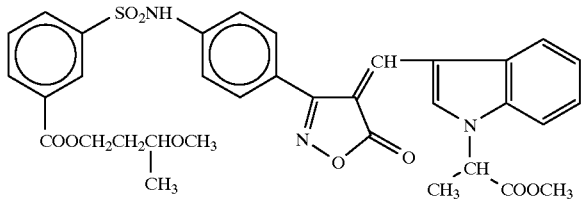
ExF-6
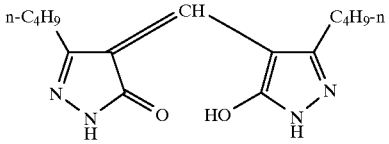
ExF-7
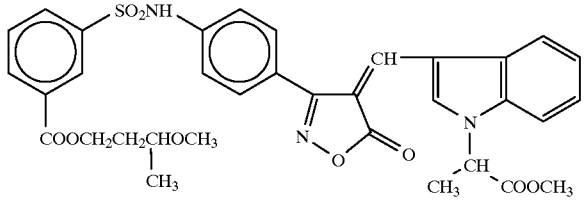
Cpd-1
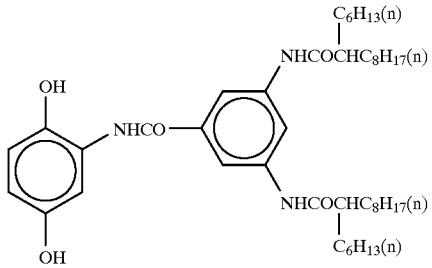

-continued
Cpd-2
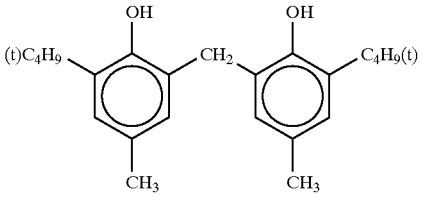
Cpd-3
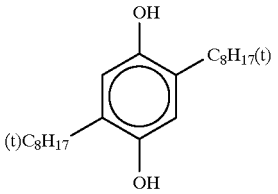
UV-1
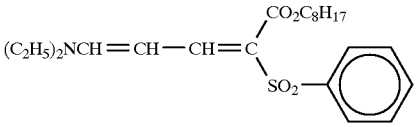
UV-2
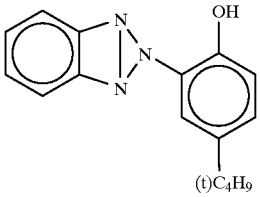
UV-3
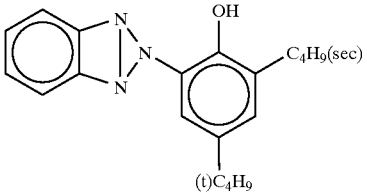
HBS-1
Tricresyl phosphate
HBS-2
Di-n-butylphthalate
HBS-4
Tri(2-ethylhexyl)phosphate
ExS-1
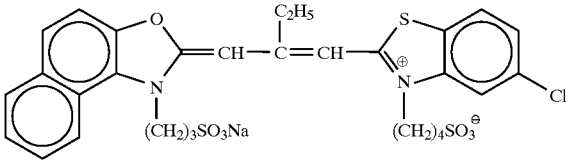
HBS-3
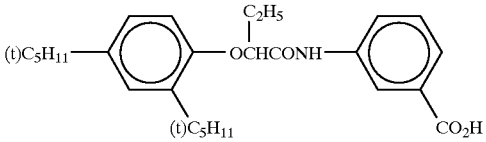
HBS-4
Tri(2-ethylhexyl)phosphate -continued
ExS-1
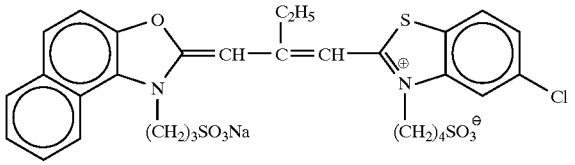
ExS-2
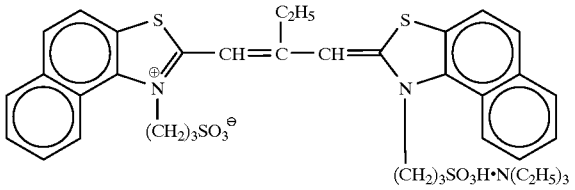
ExS-3
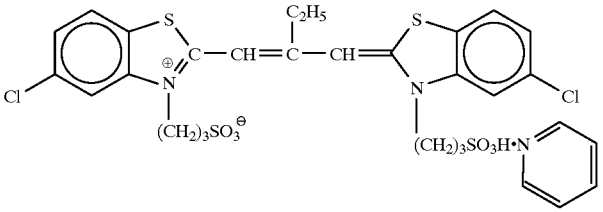
ExS-4
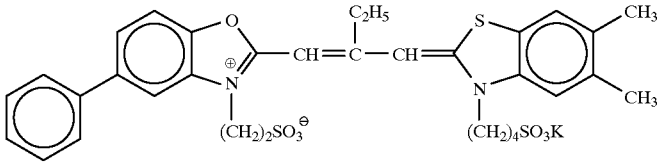
ExS-5
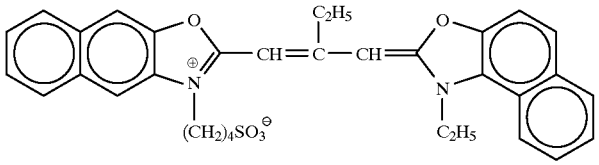
ExS-6
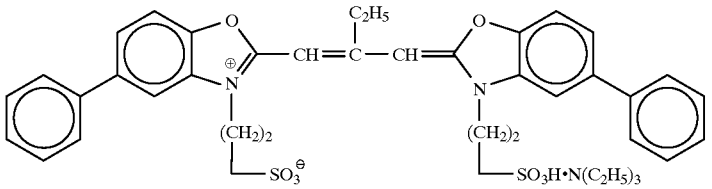
ExS-7
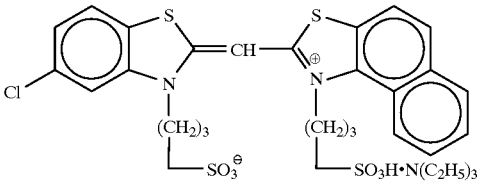
S-1
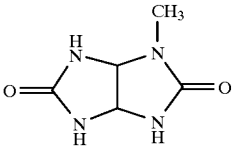

-continued
H-1
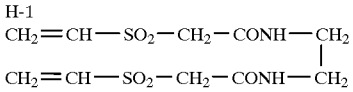
B-1
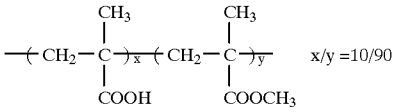
x/y =10/90
B-2
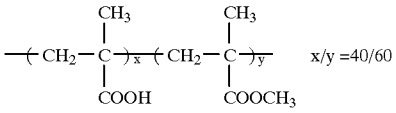
x/y =40/60
B-3
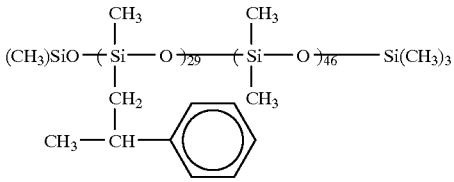
B-4
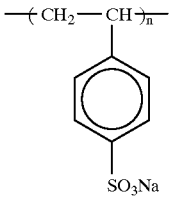
B-5
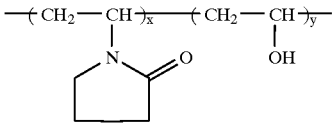
x/y = 70/30
B-6
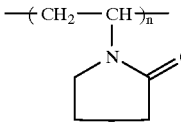
(mol. wt. 10,000)
W-1
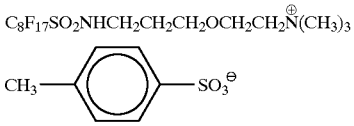
W-2
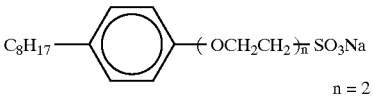
n = 2 ~ 4
W-3
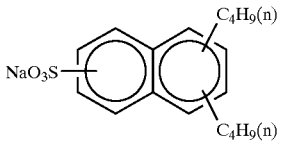
F-1
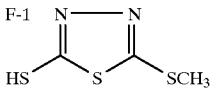

-continued
F-2
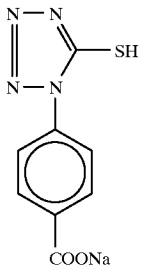
F-3
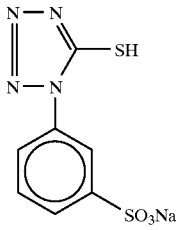
F-4
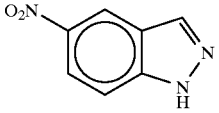
F-5
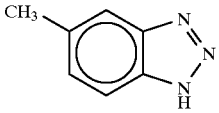
F-6
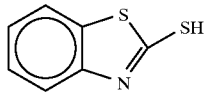
F-7
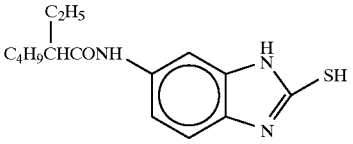
F-8
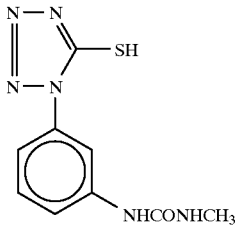
F-9
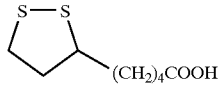

-continued

F-10

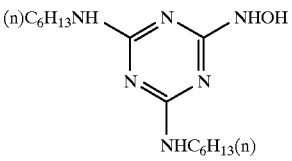

F-11

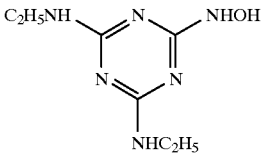

F-15

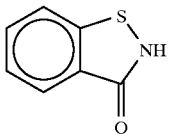

F-12

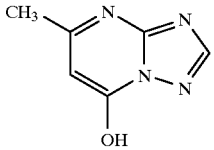

F-13

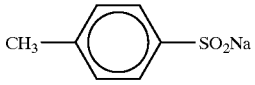

F-14

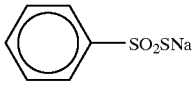

F-15

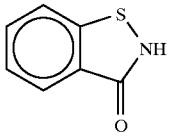

F-16

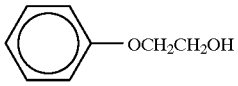

F-17

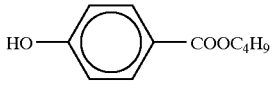

While the invention has been described in detail and with reference to specific embodiments thereof, it will be apparent to one skilled in the art that various changes and modifications can be made therein without departing from the spirit and scope thereof.

What is claimed is:

1. A silver halide emulsion, comprising tabular silver halide grains, wherein said tabular silver halide grains have {100} planes as two main parallel planes, have an aspect ratio of from not less than 2 to not more than 15, have a silver chloride content of 60mol % or more, and have been subjected to sensitization with selenium or tellurium sensitizers and with gold and sulfur sensitizers, wherein the surfaces of said tabular silver halide grains are formed of a silver salt selected from the group consisting of silver bromide, silver iodide and silver bromoiodide by the addition of an organic compound which releases at least one of bromide ions and iodide ions, wherein said surface is less soluble than silver chloride, and wherein said tabular silver halide grains are present in a proportion of 50% or more of all the silver halide grains contained therein as calculated in terms of projected area.

2. A silver halide photographic material, comprising a silver halide emulsion as defined in claim 1 incorporated in at least one silver halide emulsion layer provided on a support.

3. The silver halide emulsion according to claim 1, wherein the content (Z) of said silver salt on said surface is in the range of 0.8 to 1.2 times the average content ($Z_0$) of said silver salt on the surface of all the silver halide grains, based on mol %.

4. The silver halide emulsion according to claim 1, wherein the content (Z) of said silver salt on said surface is in the range of 0.9 to 1.1 times the average content ($Z_0$) of said silver salt on the surface of all the silver halide grains, based on mol %.

5. The silver halide emulsion according to claim 1, wherein said tabular silver halide grains are formed in the presence of an agent for oxidizing silver.

6. The silver halide emulsion according to claim 1, wherein said tabular silver halide grains have been subjected to spectral sensitization with a cyanine dye.

7. The silver halide emulsion according to claim 1, wherein said tabular silver halide grains have been subjected to sensitization with gold and sulfur sensitizers in the presence of a cyanine dye.

8. The silver halide emulsion of claim 1, wherein the organic compound is selected from the group consisting of compounds represented by formula (I) and formula (II):

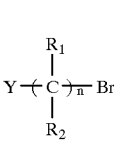

(I)

wherein R represents a monovalent organic residue which releases iodide ions upon reacting with a base and/or a nucleophilic reagent;

(II)

wherein Y represents a group having a Hammett σp value greater than 0; $R_1$ and $R_2$, which may be the same or different, are selected from the group consisting of hydrogen, an alkyl group, an alkenyl group, an aralkyl group, an aryl group, and a group represented by Y; Y and $R_1$ may undergo ring closure to form a heterocyclic ring; and n is an integer of from 1 to 3.

* * * * *